United States Patent [19]

Ito et al.

[11] Patent Number: 4,743,945

[45] Date of Patent: May 10, 1988

[54] COPYING APPARATUS WHICH FORMS IMAGES PLURAL TIMES ON THE SAME COPY PAPER

[75] Inventors: Masazumi Ito, Toyohashi; Yoshihiro Hanada, Toyokawa, both of Japan

[73] Assignee: Minolta Camera Kabushiki Kaisha, Osaka, Japan

[21] Appl. No.: 883,144

[22] Filed: Jul. 8, 1986

[30] Foreign Application Priority Data

Jul. 9, 1985 [JP] Japan ..... 60-153117

[51] Int. Cl.[4] ..... G03G 15/00; G03B 27/32

[52] U.S. Cl. ..... 355/14 SH; 355/3 SH; 355/14 R; 355/23

[58] Field of Search ..... 355/3 SH, 14 SH, 14 R, 355/23, 24, 25

[56] References Cited

U.S. PATENT DOCUMENTS

| | | | |
|---|---|---|---|
| 3,645,615 | 2/1972 | Spear, Jr. | 355/3 |
| 3,989,371 | 11/1976 | Valentine | 355/14 R |
| 4,017,173 | 4/1977 | Komori et al. | 355/8 |
| 4,173,410 | 11/1979 | Tabata et al. | 355/3 SH |
| 4,253,759 | 3/1981 | Rattin | 355/3 SH |
| 4,537,497 | 8/1985 | Masuda | 355/14 R |
| 4,575,227 | 3/1986 | Ito et al. | 355/56 |
| 4,585,336 | 4/1986 | Tanaka | 355/3 SH |

FOREIGN PATENT DOCUMENTS

| | | | |
|---|---|---|---|
| 109445 | 8/1979 | Japan | 355/3 SH |
| 38760 | 2/1984 | Japan | 355/14 R |

*Primary Examiner*—A. T. Grimley
*Assistant Examiner*—Ed Pipala
*Attorney, Agent, or Firm*—Burns, Doane, Swecker & Mathis

[57] ABSTRACT

The present invention relates to a copying machine capable of executing a duplex mode copying and composite mode copying. The copying machine has an intermediate tray for receiving and aligning the copied papers and for re-feeding them to an image formation station. The operation of the intermediate tray is controlled in accordance with the copy mode.

9 Claims, 22 Drawing Sheets

COPYING APPARATUS WHICH FORMS IMAGES PLURAL TIMES ON THE SAME COPY PAPER

BACKGROUND OF THE INVENTION

1. Field of the Invention

The present invention relates to a copying apparatus which forms images plural times on the same copy paper and more specifically to a copying apparatus which is capable of realizing duplex copying wherein pictures are formed on the front and rear surfaces of the same copy paper and composite copying where images are formed plural times on the same surface of copy paper.

2. Description of the Prior Art

For years, copying apparatus providing a variety of functions have been developed, realizing duplex copying where pictures are formed on the front and rear surfaces of the same copy paper and composite copying where different images (for example, a frame and letters in the frame) are formed or images in different colors are also formed on the same surface of the copy paper. In order to realize such functions, a copied paper is once sent to an intermediate tray where it must be supplied again. Therefore, in the case of duplex copying, the copy paper to be sent to the intermediate tray must be inverted.

Here, it is desirable, considering space saving of carrying route, simplification, easiness in removing jam paper until a copy paper is sent to the intermediate tray after the copying, that the copy papers are sent separate from the front side or rear side of the paper re-feeding direction onto the intermediate tray in the duplex copying and composite copying operation modes.

In this case, the copy papers sent from the front or rear side of the re-feeding direction must be aligned at the front or rear end thereof on the intermediate tray in accordance with their size.

U.S. Pat. No. 4,537,497 disclosures a copying apparatus where an intermediate tray itself is inclined in order to align the front end of copy papers fed from the front and rear sides of both feeding directions of the intermediate tray and thereby the copy papers fed to the intermediate tray are aligned by the weight of the papers themselves.

However, a large space for accommodating the intermediate tray is necessary in order to provide for the inclined intermediate tray. Moreover, in the intermediate tray, the copy papers become warped and are arranged irregularly.

SUMMARY OF THE INVENTION

The present invention has been proposed to eliminate such disadvantages and it is an object of the present invention to provide an automatic duplex copying and a composite copying apparatus which aligns the copy papers accurately in the front and rear ends thereof on the intermediate tray during the duplex copying and composite copying operations.

In order to attain the above object, a copying apparatus of the present invention comprises;

a first sheet storing means which stores the sheets to be copied, an image forming means which forms copied image off a sheet, a first paper feed means which feeds the copy papers sheet by sheet from said first sheet storing means, a second sheet storing means which once stores the sheets on which images are formed and provides a mechanism for aligning the front and rear ends of said sheets, a first transport means which sends the sheets on which images are formed to the second sheet storing means, a second transport means which sends sheets on which images are formed to the second sheet storing means in such a manner that the sheets transported by said second transport means are reversed in front and rear sides from the sheets transported by said first transport means, a change-over means which selectively sends the sheets to said first or second transport means, a first mode designating means which designates the mode where images are formed on both sides of a sheet, a second mode designating means which designates the mode where images are formed several times on the same surface of the sheet, and a control means which controls said change-over means and second sheet storing means in accordance with mode selection by said mode designating means.

BRIEF DESCRIPTION OF THE DRAWINGS

These objects and features of the present invention will become apparent from the following description taken in conjunction with the preferred embodiment thereof with reference to the accompanying drawings, in which.

DETAILED DESCRIPTION OF THE INVENTION

Figure 1:
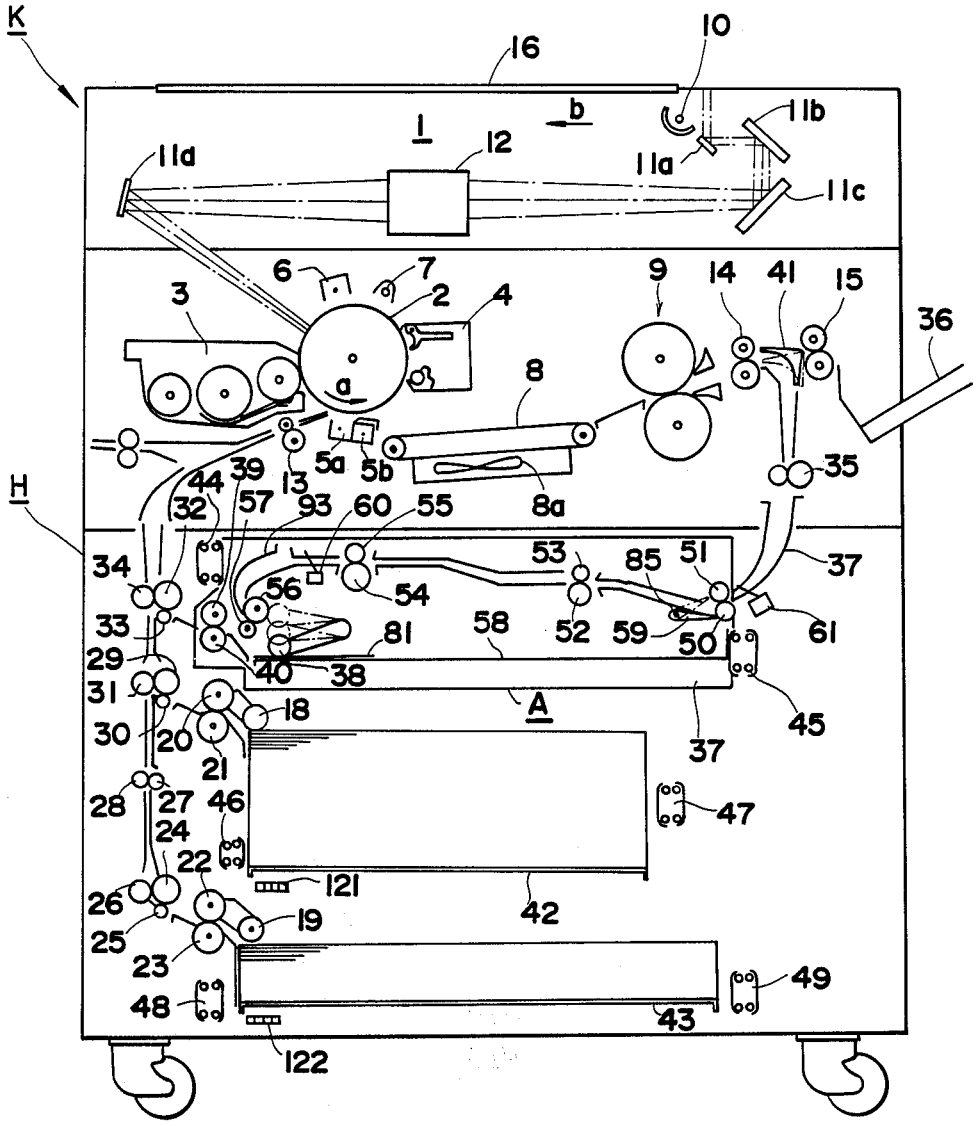
FIG. 1 is a view showing a whole construction of a copying apparatus according to one embodiment of the present invention.

Initially, a whole construction and operations of the copying apparatus K is described with reference to FIG. 1. The copying apparatus K includes a photosensitive drum 2 provided at a central portion of an apparatus housing H of the copying apparatus K and rotatable in the direction of the arrow a. Around the photosensitive drum 2, a corona charger 6, a magnetic brush type developing device 3, a transfer charger 5*a*, a charge eraser 5*b*, a blade type cleaning device 4 and an eraser lamp 7 are sequentially disposed in this order. Upon rotation of the photosensitive drum 2 in the direction of the arrow a, the photosensitive drum 2 is subjected to uniform corona charging by the corona charger 6 and then, is subjected to exposure by an optical system 1 such that an electrostatic latent image is formed on the photosensitive drum 2. The electrostatic latent image is developed into a visible toner image by the developing device 3.

The optical system is movably provided below an original platform 16 made of glass so as to scan an original document on the original platform in the direction of the arrow b and is constituted by a light source 10, movable mirrors 11*a*, 11*b* and 11*c*, an imaging lens 12 and a fixed mirror 11*d*. When the drum 2 rotates at a peripheral velocity V (which is constant irrespective of magnification), the light source 10 and the movable mirror 11*a* travel unitedly leftward at a velocity of V/m (where m is a magnification), while the movable mirrors 11*b* and 11*c* travel unitedly leftward at a velocity of V/2m.

On the other hand, a copy paper storage portion is constituted by an upper storage portion 42 of elevator type and a lower storage portion 43 of cassette type, which are drawably provided so as to be drawn out of the apparatus housing H forwardly by using rails 46 and 47 and rails 48 and 49, respectively. Copy paper sheets stacked in the upper storage portion 42 and the lower storage portion 43 are selectively fed, after their separation into a single copy paper sheet effected by a pair of separating rollers 20 and 21 and a pair of separating rollers 22 and 23, one sheet by one sheet upon rotation of paper feeding rollers 18 and 19, respectively. Then the sheets are conveyed to timing rollers 13 via a group of transport rollers 29, 30, 31, 32, 33 and 34 and a group of transport rollers 24, 25, 26, 27 and 28, respectively. After the copy paper sheets have been temporarily stopped at the timing rollers 13, the copy paper sheets are transported to a transfer portion synchronously with the above described toner image formed on the photosensitive drum 2 such that the toner image is transferred onto the copy paper sheets through electric discharge of the transfer charger 5*a*. In addition, the copy paper sheets are separated from the surface of the photosensitive drum 2 through electric discharge of the charge eraser 5*b* and then, are conveyed to a fixing device 9 by a transport belt 8 including an air suction means 8*a* such that the toner image on the copy paper sheets is subjected to fusion fixing by the fixing device 9.

A lever 41 for effecting changeover of a feed passage of the copy paper sheets is provided between transport rollers 14 and discharge rollers 15, with the transport rollers 14 being disposed in close vicinity to the outlet of the fixing device 9. In the case where the copy paper sheets are discharged directly to a tray 36, the lever 41 is set at the position shown by the one-dot chain lines of FIG. 1 and thus, the copy paper sheets transported from the fixing device 9 are discharged from the outlet rollers 15 onto the tray 36. Meanwhile, in the case where duplex copying or composite copying to be described later in detail is performed, the lever 41 is set at the position shown by the solid lines of FIG. 1 and thus, the copy paper sheets are conveyed from transport rollers 35, through a guide plate 37, to an intermediate tray unit A to be described later.

On the other hand, after the toner image on the photosensitive drum 2 has been transferred onto the copy paper sheets, residual toner is removed from the photosensitive drum 2 by the cleaning device 4 and residual electric charge is removed from the photosensitive drum 2 by light irradiated by the eraser lamp 7 such that the photosensitive drum 2 is ready for the next copying operation.

Now, construction of the intermediate tray unit A will be described briefly with reference to FIGS. 1 to 3. The intermediate tray unit A is designed to store the copy paper sheets each having one copied face so as to align the copy paper sheets with each other and re-feed the aligned copy paper sheets. The intermediate tray unit A is constituted by a changeover block I, a transport block II, a turnover block III, an intermediate alignment block IV and a re-feeding block V which are integrally assembled with each other as one unit. The intermediate tray unit A is drawably supported, at its opposite sides, by rails 44 and 45 so as to be drawn out of the apparatus housing H forwardly, i.e. in the direction perpendicular to the feed passage of the copy paper sheets as shown in FIG. 2. The intermediate tray unit A is arranged to be drawn out of the apparatus housing H such that maintenance of the copying apparatus K and disposal of jamming of the copy paper sheets are facilitated.

The inner construction of the intermediate tray unit A will be explained in detail hereinafter with reference to FIG. 3.

The changeover block I is arranged to direct the copied face of the copy paper sheets upwardly and downwardly when the copy paper sheets are transported into the intermediate tray unit A for duplex copying and composite copying, respectively. The changeover block I is constituted by transport rollers 50 and 51 and a changeover lever 59. It can also be arranged so that the changeover block I is provided on the apparatus housing H without being provided in the intermediate tray unit A.

The transport block II is arranged to transport the copy paper sheets to the turnover block III described later to be subjected to duplex copying and is constituted by transport rollers 52, 53, 54 and 55 and guide plates 201, 202, 203 and 204. When the intermediate tray unit A has been drawn out of the apparatus housing H forwardly, the transport block II can be pivoted upwardly about a support shaft 95 as shown by the one-dot chain lines of FIG. 3 such that disposal of jamming of the copy paper sheets in the intermediate tray unit A is facilitated.

The turnover block III is constituted by turnover transport rollers 56 and 57 and a turnover guide plate 93 so as to turn over and convey into an intermediate tray 58 the copy paper sheets transported through the transport block II.

The intermediate alignment block IV is constituted by the intermediate tray 58, a slide rail 77, slide members 73 and 79 and regulating plates 62, 63 64 and 65

Figure 5:
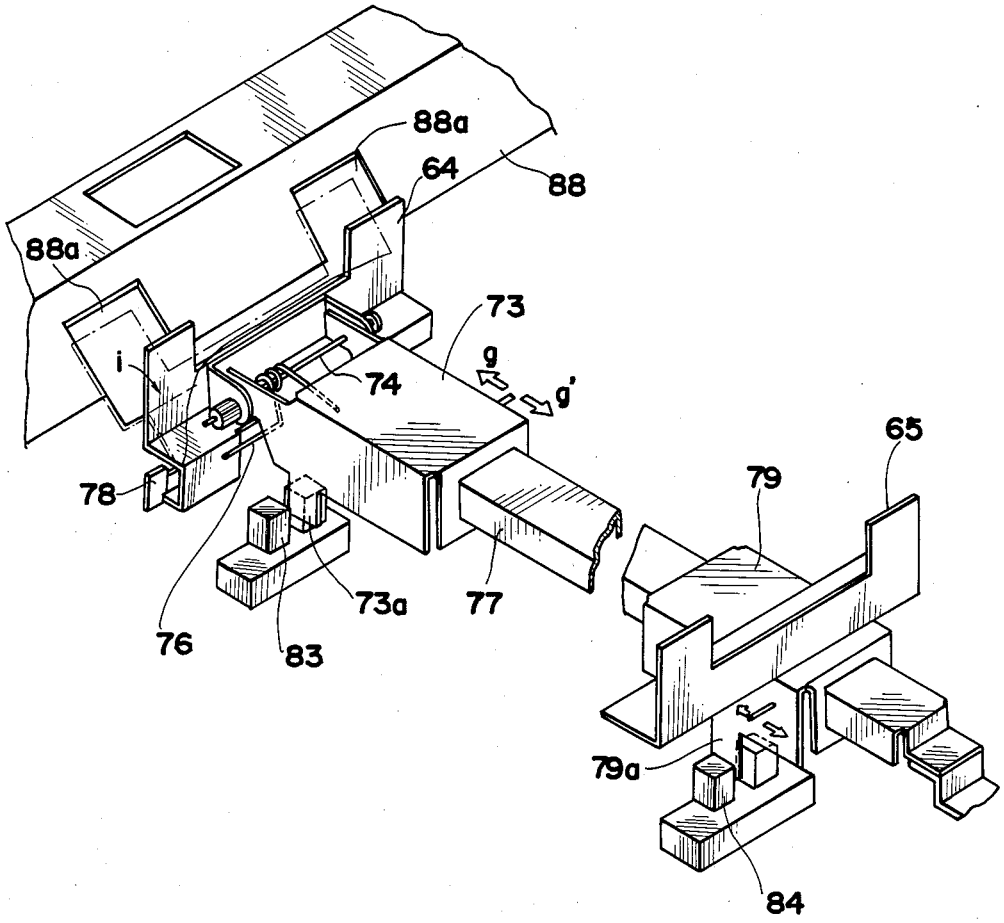
FIG. 5 is a perspective view of a mounting portion for regulating plates employed in the copying apparatus of FIG. 1.

(The regulating plates 62, 63, 64 and 65 are shown in FIG. 5) so as to align with each other the copy paper sheets transported onto the intermediate tray 58.

Meanwhile, the re-feeding block V is constituted by a holder 66, a re-feeding roller 38, separating rollers 39 and 40 and a guide plate 88 so as to re-feed, one sheet at a time, the copy paper sheets aligned on the intermediate tray 58.

Figure 2:
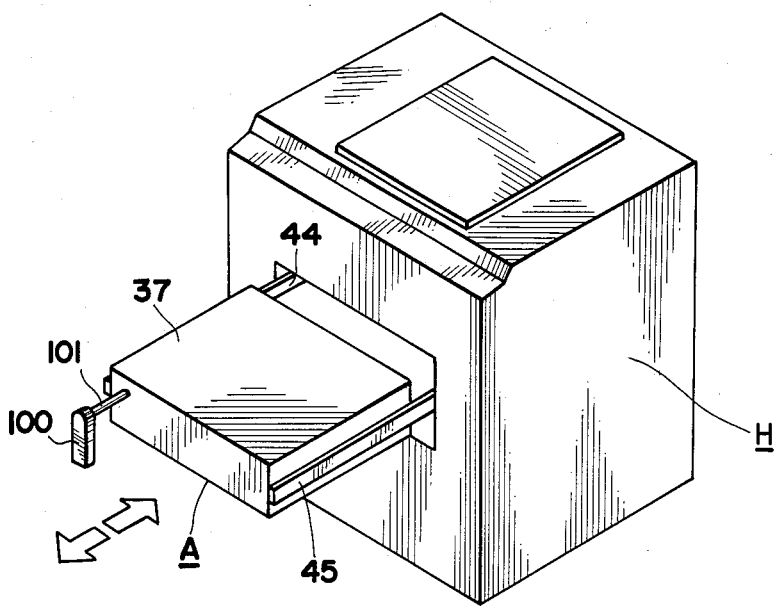
FIG. 2 is a perspective view of the copying apparatus of FIG. 1.

When either one of a duplex copying mode or a composite copying mode has been selected by depressing a selective key on an operating panel (not shown), the changeover lever 41 referred to earlier is changed over to the position shown by the solid lines of FIG. 1 and thus, the copy paper sheets each having one copied face are guided from the transport rollers 35 to the transport rollers 50 and 51 by the guide plate 37.

Figure 3:
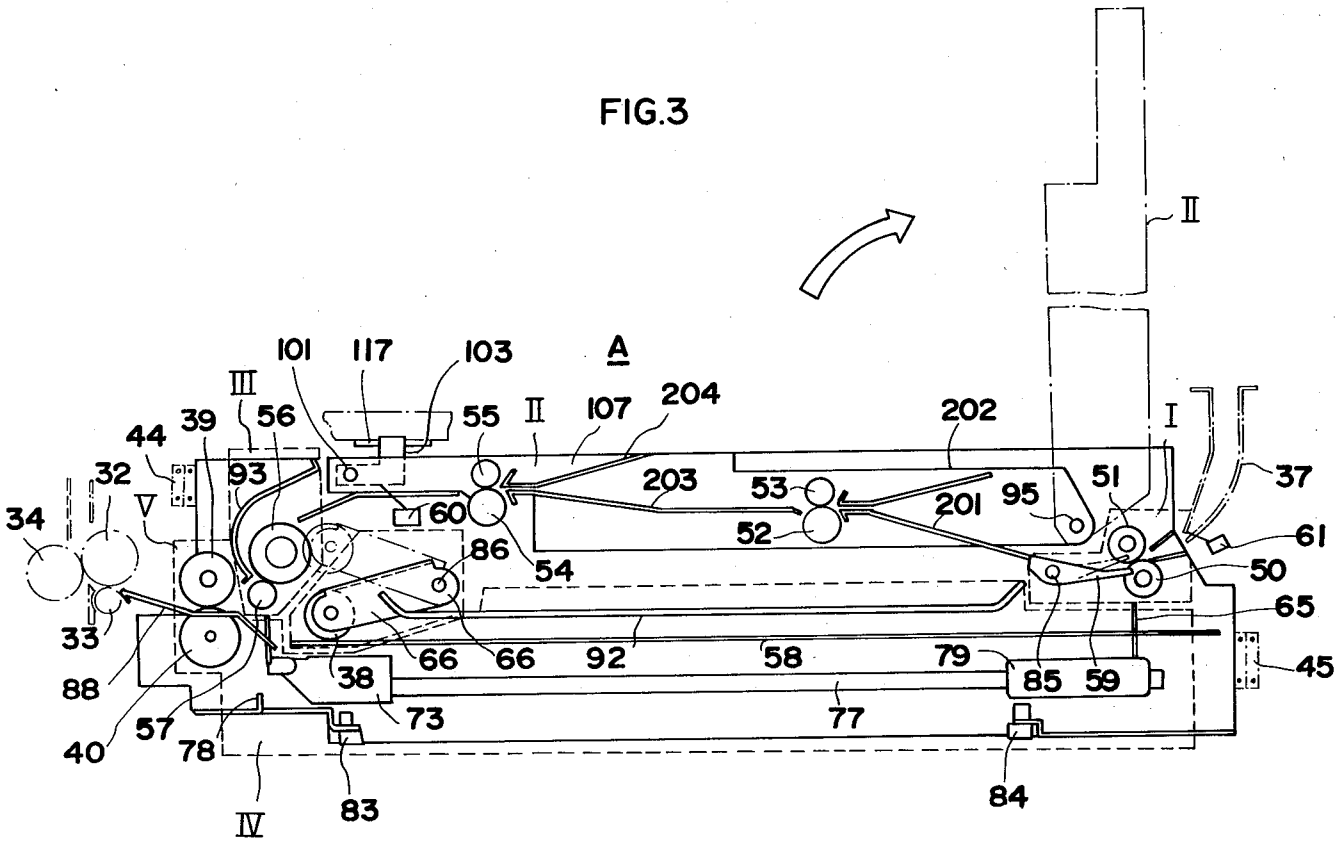
FIG. 3 is a view showing an inner construction of a unit employed in the copying apparatus of FIG. 1.

Another changeover lever 59 is pivotally provided so as to be pivoted about a shaft 85 and is set at the position shown by the solid lines of FIG. 3 at the time of duplex copying. At this time, the copy paper sheets fed into the intermediate tray unit A are guided to the transport block II by an upper face of the changeover lever 59 and then, are conveyed in the leftward direction in FIG. 3 by the transport rollers 52, 53, 54 and 55 through guide of the guide plates 201, 202, 203 and 204. Subsequently, the copy paper sheets are turned over by the turnover transport rollers 56 and 57 and the turnover guide plate 93 such that the copy paper sheets each having one copied face directed upwardly are transported onto the intermediate tray 58. Thereafter, the copy paper sheets are aligned with each other on the intermediate tray 58 by the intermediate alignment tray block IV so as to be re-fed one sheet at a time upon clockwise rotation of the re-feeding roller 38.

On the other hand, at the time of composite copying, the changeover lever 59 is set at the position shown by the one-dot chain lines of FIG. 3. At this time, the copy paper sheets are guided by a lower face of the changeover lever 59 immediately after having passed through the transport rollers 50 and 51 such that the copy paper sheets each having one copied face directed downwardly are directly conveyed onto the intermediate tray 58. Subsequently, the copy paper sheets are re-fed one sheet at a time upon clockwise rotation of the re-feeding roller 38 in the same manner as duplex copying.

The re-fed copy paper sheets are transported, after their separation into a single copy paper sheet effected by the separating rollers 39 and 40, to the timing rollers 13 via the transport rollers 32, 33 and 34. Thereafter, duplex copying or composite copying is performed in the same manner as an ordinary copying operation. Meanwhile, the re-feeding roller 38 is pivotally provided so as to be pivoted about a support shaft 86 of the holder 66 (see FIG. 3) such that the re-feeding roller 38 is positioned at three stages shown by the one-dot chain lines, the dotted lines and the solid lines in FIG. 1, respectively. When the copy paper sheets are transported to the intermediate tray 58, the re-feeding roller 38 is positioned at the upper stage or the intermediate stage as will be described in detail later. At the time of re-feeding of the copy paper sheets, the re-feeding roller 38 is brought into pressing contact, at a proper pressure, with the copy paper sheets aligned on the intermediate tray 58.

Figure 4:
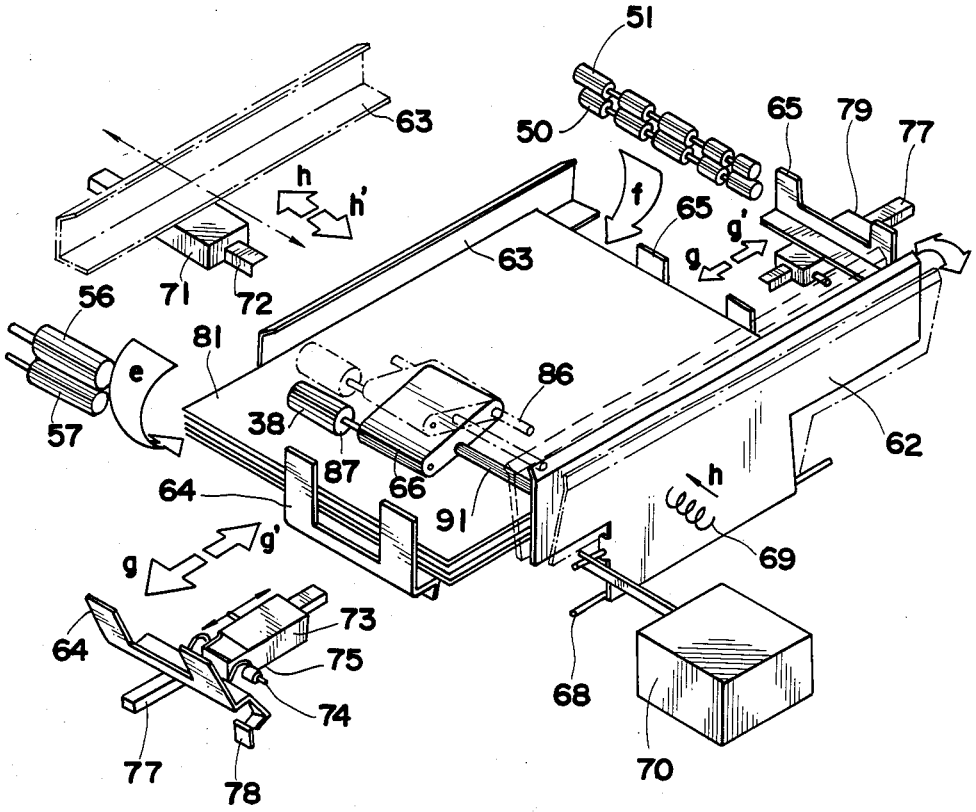
FIG. 4 is an exploded prespective view of an alignment mechanism and a re-feeding mechanism employed in the copying apparatus of FIG. 1.

Now an alignment mechanism for aligning the copy paper sheets 81 transported onto the intermediate tray 58 will be described with reference to FIGS. 4 to 7. In FIG. 4, the arrow e indicates a direction of feed of the copy paper sheets 81 onto the intermediate tray 58 at the time of duplex copying. Similarly, the arrow f indicates a direction of feed of the copy paper sheets 81 onto the intermediate tray 58 at the time of composite copying, while the arrow g indicates a re-feeding direction of the copy paper sheets 81.

The copy paper sheets 81 are aligned with each other by the four regulating plates 62, 63, 64 and 65. the side regulating plate 62 is pivotally provided so as to be pivoted about a support shaft 68, while another side regulating plate 63 is movably mounted on a slide rail 72 through a slide member 71. The front regulating plate 64 and the rear regulating plate 65 are movably mounted on the slide rail 77 through the slide members 73 and 79, respectively. When the slide member 71 is driven by a stepping motor 331 (shown in FIG. 22), the side regulating plate 63 is displaced in the directions of the arrows h and h'. Likewise, when the slide members 73 and 79 are driven by stepping motors 332, 333, the front and rear regulating plates 64 and 65 are displaced in the directions of the arrows g and g'. The amount of displacement of the regulating plates 63, 64 and 65 are set at predetermined values by controlling the rotational angles of the stepping motors, respectively.

Figure 6:
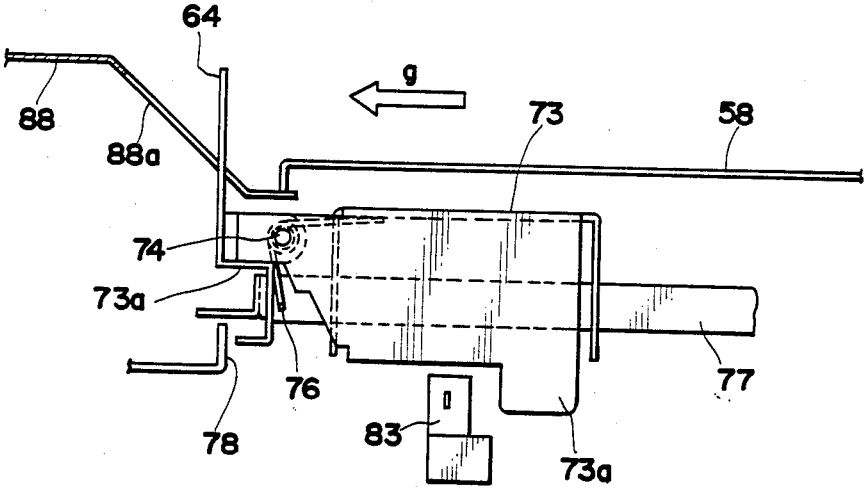
FIG. 6 and FIG. 7 are views explanatory of operations of a front regulating plate employed in the copying apparatus of FIG. 1.
Figure 8:
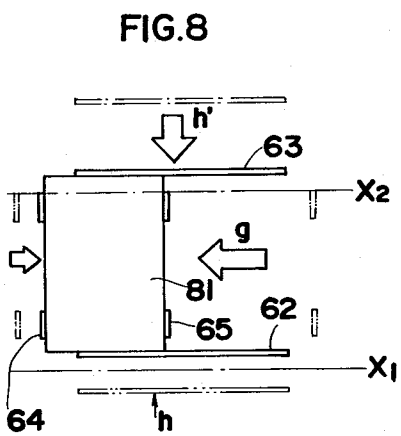
FIG. 8 is a top plan view of the alignment mechanism of FIG. 5 at the time of duplex copying.

As shown in FIG. 5, the front regulating plate 64 is pivotally mounted on the slide member 73 so as to be pivoted about a support shaft 74 and is urged in the direction of the arrow i by a torsion spring 75 wound around the support shaft 74. The regulating plate 64 is usually regulated by a lower edge **73*a* of a projection of the slide member 73 so as to extend at right angles to the intermediate tray 58 as shown in FIG. 6. This front regulating plate 64 disposed at the position of FIG. 6 aligns leading edges of the copy paper sheets 81 transported onto the intermediate tray 58. At the time of re-feeding of the copy paper sheets 81, the slide member 73 is displaced in the direction of the arrow g, so that the front regulating plate 64 is pivoted, through contact of its lower end with a stopper 78, about the support shaft 74 in the direction of the arrow i' against an urging force of the torsion spring 75 as shown in FIG. 8 so as to be retracted into a pair of recesses 88*a* formed on the guide plate 88 such that re-feeding of the copy paper sheets 81** can be performed.

Figure 7:
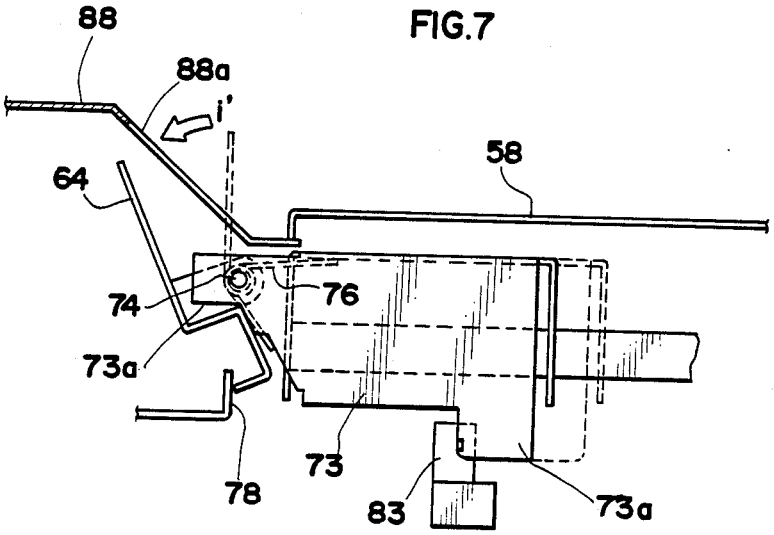
Figure 10:
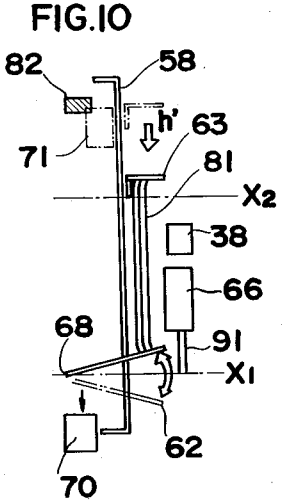
FIG. 10 is a side elevational view of FIG. 8.

The front regulating plate 64 can be displaced to a re-feeding position shown by the solid lines of FIG. 7, an alignment position (FIG. 6) for aligning the leading edges of the copy paper sheets 81 and a temporary alignment position for composite copying. The temporary alignment position of the front regulating plate 64, which will be explained later, varies according to size of the copy paper sheets 81. Positional control of the front regulating plate 64 is based on detection of a protrusion **73*a* of the slide member 73 by a transmission type photosensor 83 as shown in FIG. 7. Similarly, as shown in FIG. 5, positional control of the rear regulating plate 65 is based on detection of a protrusion 79*a* of the slide member 79 by a transmission type photosensor 84. Positional control of the side regulating plate 63 is likewise based on detection of a fixed position of the slide member 71 by a transmission type photosensor 82 as shown in FIG. 10**.

Meanwhile, as shown in FIG. 4, the side regulating plate 62 is coupled with a solenoid 70 and is urged in the direction of the arrow h by a coiled spring 69. Since the solenoid 70 is usually de-energized, the side regulating plate 62 is disposed at the position shown by the dotted lines of FIG. 4 through its contact with a stopper (not shown). At the time of re-feeding of the copy paper sheets, the side regulating plate 62 is brought into contact with a stopper 91 formed on the holder 66 of the re-feeding roller 38 so as to be set at the position shown by the solid lines of FIG. 4. When the solenoid 70 has been energized, the side regulating plate 62 is pivoted about the support shaft 68 to the position shown by the one-dot chain lines of FIG. 4 against an urging force of the coiled spring 69.

Now, the aligning operation of copy paper (81) on the intermediate tray (58) is explained in accordance with the copying procedures.

[1] Alignment in duplex copying:

(a) First, the copy papers of necessary size are selected from those stored in the copy paper storages (42), (43). This selection is carried out by depressing a size selection key (309) on the operation panel (300) of FIG. 20 and the size of copy paper is detected by the sensors (121), (122) provided on the storages (42), (43). (refer to FIG. 1) The sensors (121), (122) output a code signal as is well known and the outputs thereof (121*a*) (121*c*), (122*a*) (122*c*) are input to a matrix (342) shown in FIG. 21.

(b) The copy mode is set to duplex copying mode by turning on the duplex copying selection key (303) on the operation panel (300).

Here, said change-over levers (41), (59) (refer to FIG. 1) are set to the position of the solid line.

Figure 9:
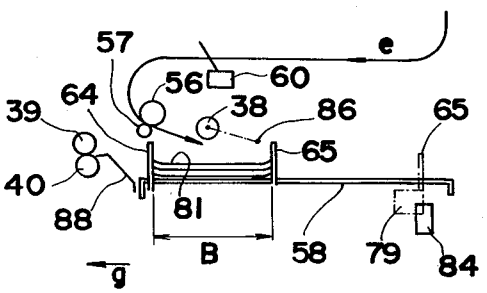
FIG. 9 is a front elevational view of FIG. 8.

The regulating plates (63), (64), (65) are moved to the position indicated by a solid line of FIGS. 8 to 10 by the stepping motors (331), (332), (333) and are set in the waiting condition. This waiting position is a little larger than the selected size of copy paper. Namely, the front end regulating plate (64) is waiting at the position displaced a litle in the re-feeding direction (arrow mark (g)) from the contact point of turnover transport rollers (56), (57). This is because the rear end of the copy paper (81) sent on the intermediate tray (58) with the turnover transport rollers (56), (57) must be prevented from riding over the end portion regulating plate (64) when it is separated from the contacts of turnover transport rollers (56), (57). The rear end regulating plate (65) is waiting at the position separated by the distance (B) from the waiting position of front end regulating plate (64). This distance (B) is a little larger than the selected copy paper size. A side regulating plate (63) is waiting at the position a little wider than the reference position ($X_2$) in the width direction of copy paper (81) as shown in FIG. 8. As explained above, the side regulating plate (63) is waiting at the position retreated from the transport reference position ($X_2$). This is because if the transfer route of copy paper (81) becomes long, transfer speed error is generated in the width direction due to fluctuations of outer diameter in the axial direction of each transport roller and pressurizing force and thereby the copy paper (81) may be transported under an oblique condition. Another side regulating plate (62) is pressed in the arrow direction (h) with the coil spring (69) when the solenoid (70) turns OFF and is waiting in the condition being swayed to the position of solid line (refer to FIG. 10).

Meanwhile, the re-feed roller (38) is set to the upper position (refer to FIG. 9) and moves upward so that transfer of copy paper (81) from the turnover transport rollers (56), (57) is not interfered with.

(c) Next, a number of sheets of copying is set. This setting is carried out by operating the ten keys (311) to (320) on the operation panel (300).

The steps (a), (b), (c) can be done at random.

(d) A print key (301) is turned ON.

1. The copy paper fed from the copy paper storages (42), (43) is subjected to copying on one side by the coypying process described above, transported by said transport block (11) indicated by arrow mark (e) of FIG. 9. After the detection sensor (60) turns ON, the paper is turned over by the turnover transport rollers (56), (57) and it is then sent onto the intermediate tray (58) with the copied surface facing upward.

2. Based on the ON signal of said sensor (60), the solenoid (70) is turned ON with a delay timer just before the front end of copy paper (81) reaches the intermediate tray (58), the side regulating plate (62) sways a little outside the transfer reference position ($X_1$) in the direction of arrow mark (h'). The side regulating plate (62) moves backward to the position a little widened than the transport reference position ($X_1$) to cope with inclined transport of copy paper as described above.

3. when the rear end of copy paper (81) is fed perfectly on the intermediate tray (58), the solenoid (70) is turned OFF, the side regulating plate (62) sways up to the position indicated by a solid line shown in FIG. 8, FIG. 10 with a spring force of the coil spring (69) (refer to FIG. 4). In this case, the copy paper (81) fed on the intermediate tray (58) is preliminarily aligned under the condition that it is placed under pressure in contact with the side regulating plate (63).

Figure 16:
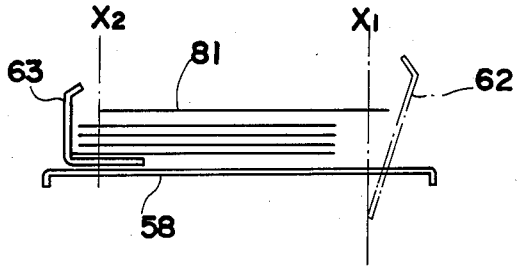
FIGS. 16 to 19 are views explanatory of alignment operations of the copy paper sheets in the copying apparatus of FIG. 1.
Figure 17:
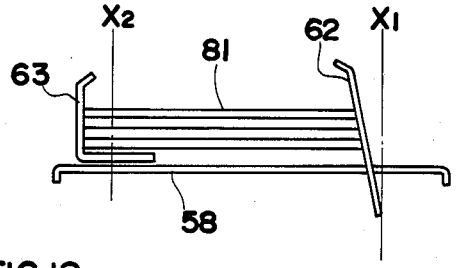

4. The processes of 1, 2 and 3 are repeated as many times as the number of copies fed onto the intermediate tray (58) and the side regulating plate (62) sways for each feed of copy paper (81). Thereby, the copy paper (81) is preliminarily aligned with the other side regulating plate (63). (refer to FIGS. 16, 17.) The alignment in this step is a preliminary alignment for assuring the final alignment to be done later.

5. After the copy papers (81) are fed to the intermediate tray (58), the solenoid (70) is turned ON and the side regulating plate (62) sways outside as indicated by the broken line in FIG. 10.

Figure 18:
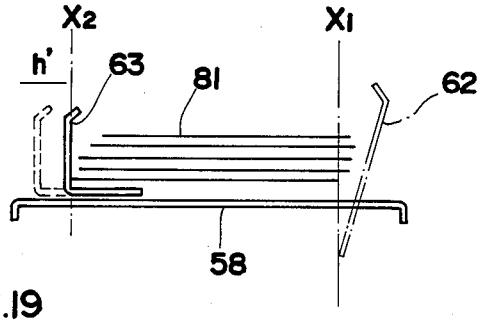

6. In this condition, since the copy papers (81) are deviated from the transport reference positions ($X_1$). ($X_2$) in the width direction, the side regulating plate (63) is moved up to the reference position ($X_2$). (refer to FIG. 18.) In this case, transport speed is desirably about 30 mm/sec or less.

7. In this case, some sheets of copy papers (81) at the upper part are deviated in the direction of arrow mark (h') from the reference position ($X_1$) with a force of inertia. (refer to FIG. 18.) For alignment of copy papers, the solenoid (70) is repeated for ON and OFF several times in order to sway the side regulating plate (62) several times until the copy papers (81) are aligned perfectly. In this process, the next process starts while the solenoid (70) is OFF.

Figure 14:
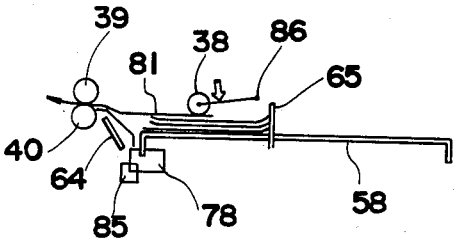
FIG. 14 is a front elevational view of FIG. 13.

8. Here, the re-feed roller (38) is located in the lower stage and is pressurizingly placed on the copy paper (81) by its own weight. (refer to FIG. 14.)

Figure 15:
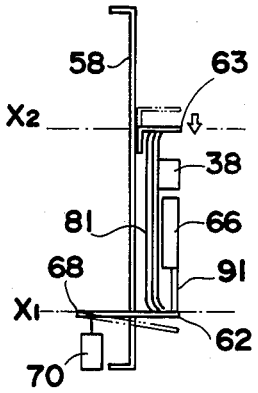
FIG. 15 is a side elevational view of FIG. 13.
Figure 19:
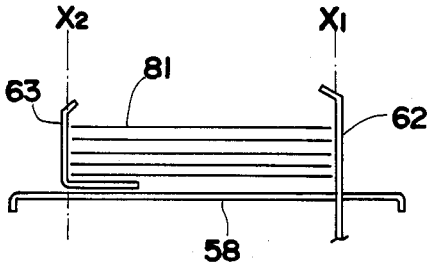

9. Next, the solenoid (70) is turned OFF. The side regulating plate (62) sways inside with spring force of a coil spring (69) but is set (refer to FIG. 15, FIG. 19) in the vertical direction at the reference position ($X_1$) where it collides with a stopper (91) (refer to FIG. 4) protruding from the holder (66). This is because the including transport of copy paper (81) during re-feeding must be prevented.

10. Simultaneously, the slide member (73) is moved up to the condition of FIG. 7. Thereby, the front end regulating plate (64) sways in the direction of arrow mark (i') with the support shaft (74) operating as a fulcrum and moves backward into the cut-away part (88*a*) of a guide plate (88), so that the front end regulating plate (64) does not interfere with the re-feeding of copy paper (81).

11. When the above operations are complete, the display [lighting of print key (301)] is carried out on the operation panel (300) of the copying apparatus informing the user that duplex copying is ready. In addition, the change-over lever (41) is set to the position of the broken line in FIG. 1.

(e) The print key (301) is turned ON.

1. A main motor (not shown) is started, rotating each transport roller in the copying apparatus.

2. The paper feed roller drive clutch (not shown) is turned ON and the re-feed roller (38) is rotated in the direction of arrow mark (i).

3. Since the friction coefficient between paper feed roller (38) and copy paper (81) is higher than that between copy papers, only a upper most sheet (81) is fed and separated one by one by the separation rollers (39), (40).

4. Thereafter, the copy paper (81) is transported up to the timing rollers (13) with the transport rollers (32), (33), (34) (refere to FIG. 1). After a toner image is transferred to the rear side and is then fixed with a fixing device (9), the copy paper is guided to the outlet rollers (15) with the changeover lever (41) and is then exhausted onto the tray (36). It is also possible that the above processes 1 to 4 can be realized automatically upon completion of the alignment of copy paper without turning ON the print switch.

[2] Alignment in composite copying:

(a) A size of copy paper is selected as in the case of 1-(a) described above.

(b) A composite copying selection key (304) on the operation panel (300) is turned ON to set the copying mode to the composite copying mode.

The change-over lever (41) is set to the position of the solid line in FIG. 1 and the change-over lever (59) is set to the position of the dotted line.

Figure 11:
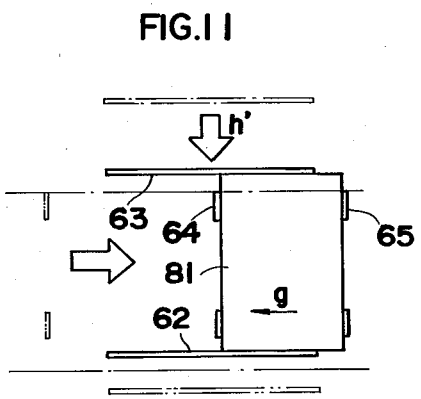
FIG. 11 is a top plan view of the alignment mechanism at the time of composite copying.
Figure 12:
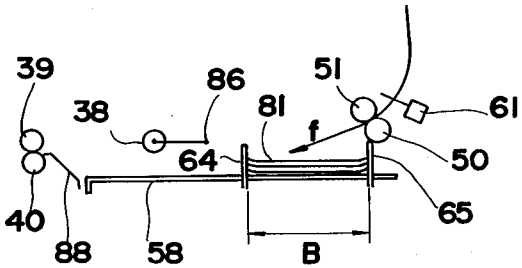
FIG. 12 is a front elevational view of FIG. 11.

The regulating plates (63), (64) are moved by the stepping motors (332), (333) to the position of the solid line shown in FIG. 11, FIG. 12 for the waiting mode. The rear end regulating plate (65) is in the waiting mode at a position displaced a little, opposite the re-feeding direction (arrow mark (g), from the contacts of transport rollers (50), (51), in order to prevent the rear end of copy paper (81) fed onto the intermediate tray (58) by the transport rollers (50), (51) from riding over the rear end regulating plate (65) when it separates from the contacts of transport rollers (50), (51). The front end regulating plate (64) waits at the position separated by the distance (B) from the waiting position of rear end regulating plate (65). This distance (B) is a little larger than the size of the copy paper selected. The side regulating plate (62) is pushed in the direction of arrow mark (h) by the coil spring (69) when the solenoid (70) is turned OFF and is swayed to the solid line waiting position (refer to FIG. 10).

Meanwhile, the re-feeding roller 38 is set in the intermediate stage position; shown in FIG. 12 and is drawn into the position so as not to interfere with the movement of copy paper (81) on the intermediate tray (58) as explained below.

(c) Next, a number of copies is set by operating the keys (311)–(320).

The steps (a), (b), (c) can be done at random in the same way as the procedures in case 1.

(d) The print key (301) is turned ON.

1. A copy paper which is once copied on a single side is transported as indicated by arrow mark (f) in FIG. 12, turning ON the detection sensor (61) and is then fed to the intermediate tray (58) from the transport rollers (50), (51) with the copied surface facing downward.

2. A delay timer is started upon receiving the ON signal from said sensor (61). The delay timer terminates immediately before the front end of a copy paper reaches the intermediate tray. Then the solenoid (70) is turned ON and the side regulating plate (62) is swayed a little outside the transfer reference position ($X_1$) in the direction of arrow mark (h').

3. When the rear end of copy paper (81) is perfectly transported on the intermediate tray (58), the side regulating plate (62) sways up to the solid line position of FIG. 11 with a spring force of the coil spring (69) (refer to FIG. 4). In this case, the copy paper (81) fed to the intermediate tray (58) is preliminarily aligned under the condition that it is placed in contact with the other side regulating plate (63).

4. Hereinafter, the processes 1, 2, 3 are repeated as many times as there are copies until the copy papers (81) are fed to the intermediate tray (58) and the side regulating plate (62) sways for each feed of a copy paper (81), causing the copy paper (81) to be preliminarily aligned with the other side regulating plate (63). (refer to FIGS. 16, 17.) This alignment is only preliminary for assuring the final alignment carried out later as in the case of said [1]-(d)-4.

5. When the copy papers (81) are fed to the intemediate tray (58), the stepping motor is started and the regulating plates (64), (65) move forward up to the re-feeding position [direction of arrow mark (g)] while keeping the interval (B) therebetween. Thereby, the copy paper (81) is fed to the re-feeding position on the intermediate tray (58).

6. Here, the solenoid (70) is turned ON causing the side regulating plate (62) to sway outside indicated by a broken line.

7. Under this condition, the copy paper (81) causes the side regulating plate (63) to move up to the reference position ($X_2$) since the copy paper (81) is deviated from the transfer reference positions ($X_1$), ($X_2$) in the width direction. (refer to FIG. 18.) IN this case, the desirable transfer speed is 30 mm/sec or less.

8. In this case, several sheets of copy papers (81) at the upper part are, as described above, deviated in the direction of arrow mark (h') from the reference position ($X_1$) with a force of inertia. (refer to FIG. 18.) In order to align the copy papers, the solenoid (70) is turned ON and OFF several times, thereby the side regulating plate (62) is swayed several times until the copy paper (81) is aligned perfectly. During this process, the next step starts while the solenoid (70) is turned ON.

9. Here, the re-feeding roller (38) is located at the lower stage and is placed under pressure in contact with the copy paper (81). (refer to FIG. 14.)

10. Next, the solenoid (70) is turned OFF. This is the same process as [1]-(d)-9 as described above. The side regulating plate (62) is forced to be in contact with the stopper (91) of holder (66) and is set in the vertical direction at the reference position ($X_1$). (refer to FIGS. 15 and 19.)

11. Simultaneously, as in the case of [1]-(d)-10, the front end regulating plate (64) is caused to be drawn into the recesses (88*a*) of the guide plate (88).

12. Upon completion of the above operations, a display [lighting of print key (301)] is carried out on the operation panel (300) of the copying apparatus indicating that the composite copying is ready. Moreover, said change-over lever (41) is set to the position indicated by the broken line of FIG. 1.

(e) The print key (301) is turned ON. The processes of [1]-(e)-1, 2, 3, 4 are executed and a composite copying is carrying over the copied surface. As described above, it is also possible for each process of [1]-(e)-1, 2, 3, 4 to be carried out automatically without turning ON the print switch when alignment of the copy paper is completed. In the above alignment method, the preliminary alignment is carried out in a position deviated in the width direction from the transport reference positions ($X_1$), ($X_2$) for each feed of the copy paper sheet (81) onto the intermediate tray (58) and after the copy papers (81) of a predetermined number of sheets are fed, realignment is carried out by moving the copy paper (81) to the transport reference positions ($X_1$), ($X_2$). Therefore, alignment is carried out reliably and accurately.

Figure 20:
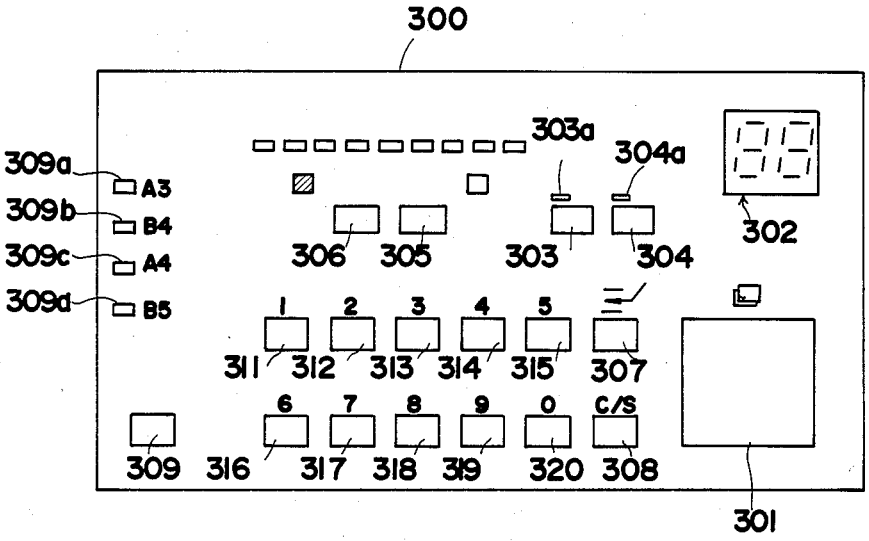
FIG. 20 is a top plan view of an operation panel.

Next, operation key arrangement off the operation panel (300) of the copying apparatus is explained with reference to FIG. 20.

The operation panel (300) is provided with a print key (301) for starting a copying operation, a numeral display (302) which displays numerals in two digits, ten keys (311)–(320) corresponding to the numerals "1", "2", . . . , "9" and "0", an interruption key (307) which designates interrupted copying, a clear stop key (308), a copy paper size selection key (309) which designates the size of copy paper in accordance with the size of storages (42), (43), up and down keys (306), (307) which alter and designate concentration of the copied image step by step and a composite copy selection key (304).

Figure 21:
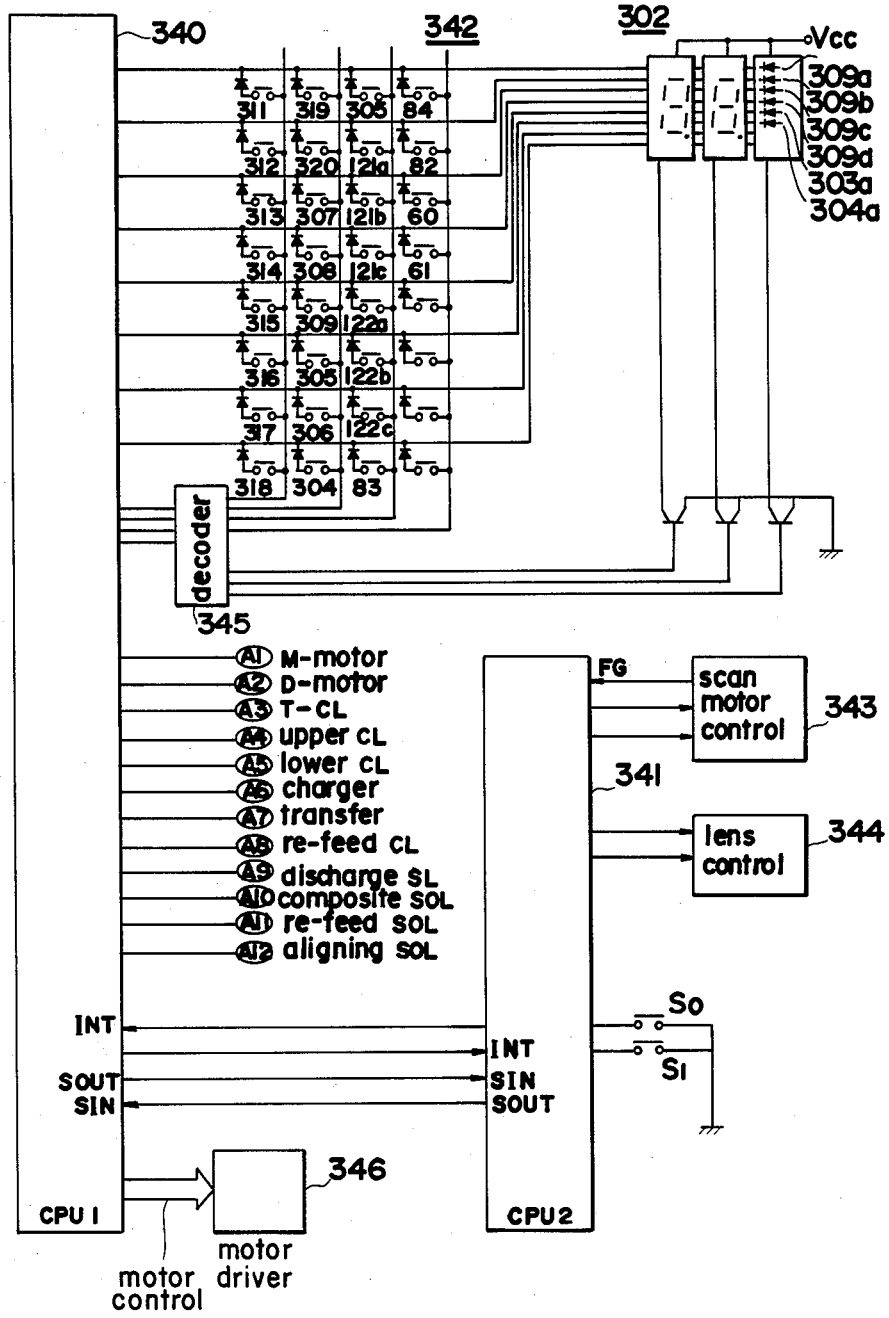

The switches corresponding to these various keys and sensors provided to the copying apparatus itself and intermediate tray unit (A) are respectively associated with a control circuit including a microcomputer system as shown in FIG. 21.

Figure 22:
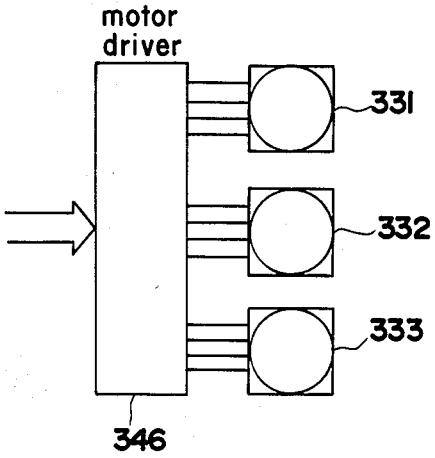
FIGS. 21, 22 are circuit diagrams of a control circuit.

Now the control circuit of this copying apparatus will be explained with reference to FIG. 21 and FIG. 22.

This control circuit is composed mainly of a first microcomputer (340) for controlling the copying operation and a second microcomputer (341) for controlling an optical system which are connected to each other. The first CPU (340) is also connected with a switch matrix (342) arranging various operation keys on the operation panel (300) and said sensors.

The output terminals (A1)–(A12) of the first CPU (340) are connected with a main motor, a developing motor, a toner supply motor, a paper feed clutch, a re-feeding clutch, and a change-over solenoid of levers (41), (59), and these are controlled for ON and OFF based on the signals sent from said switch matrix (342). Moreover, the first CPU (340) is connected with various kinds of light emitting elements (LED) such as the display (302) for indicating a number of copies through a decoder (345), which are controlled by activation and deactivation.

Meanwhile, the second CPU (341) is connected with a DC motor drive controller (343) for scanning the optical system, a stepping motor drive controller (344) for the magnification lens, a fixed position switch ($S_0$) of said optical system (1) and a timing switch ($S_1$).

The control procedures for operating the control circuit will be explained sequentially hereinafter on the basis of the flow charts of FIG. 23 and others.

Figure 23:
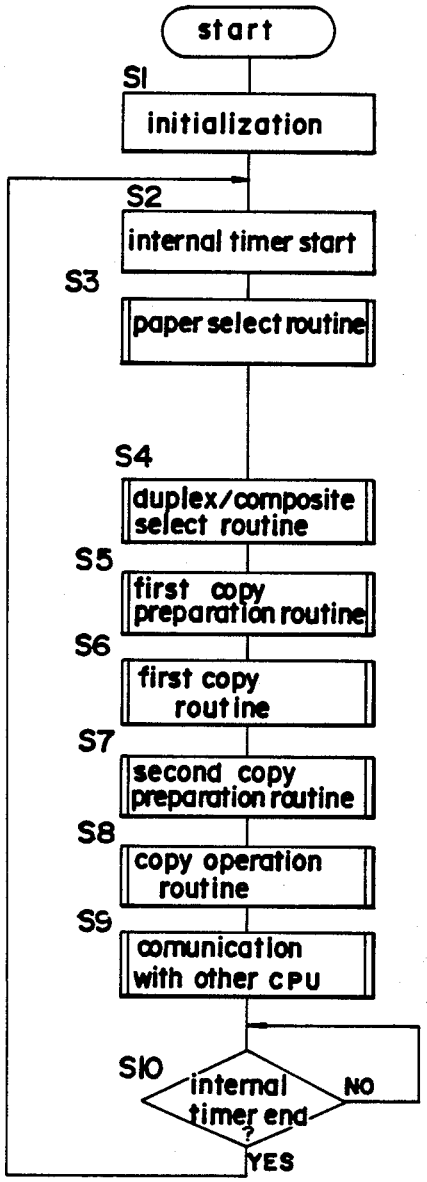
FIGS. 23 to 30 are flow charts of control procedures of a copying apparatus based on the control circuit of FIGS. 21, 22.

FIG. 23 is the main routine for control. When the power is turned ON and the CPU's (340), (341) start in the reset state, the CPU's (340), (341) are initialized in step (S1) and the initialization for setting each device to its initial mode is carried out.

An internal timer is started in step (S2). This internal timer is set in said step (S1) and determines the processing time of one routine. Various timers explained in the following subroutines judge the end of a set time by a counted value of this internal timer.

The subroutines of steps (S3)–(S8) are sequentially called and when processings of all subroutines are completed, the first CPU (340) communicates with the other CPU's in step (S9) and the operation returns to step (S2) after the end of said internal timer in step (S10).

Step (S3) is a copy paper select routine for selecting a size of copy paper, step (S4) is a duplex copying or composite copying select routine for realizing duplex copying or composite copying, step (S5) is a first copy preparation routine for preparing for execution of duplex copying or composite copying, step (S6) is a first copying routine for aligning the copy papers (81) fed into the intermediate tray (58). Step (S7) is a second copy preparation routine for the preparing for re-feeding of paper and step (S8) is a copy operation routine for executing the copy operation.

Figure 24:
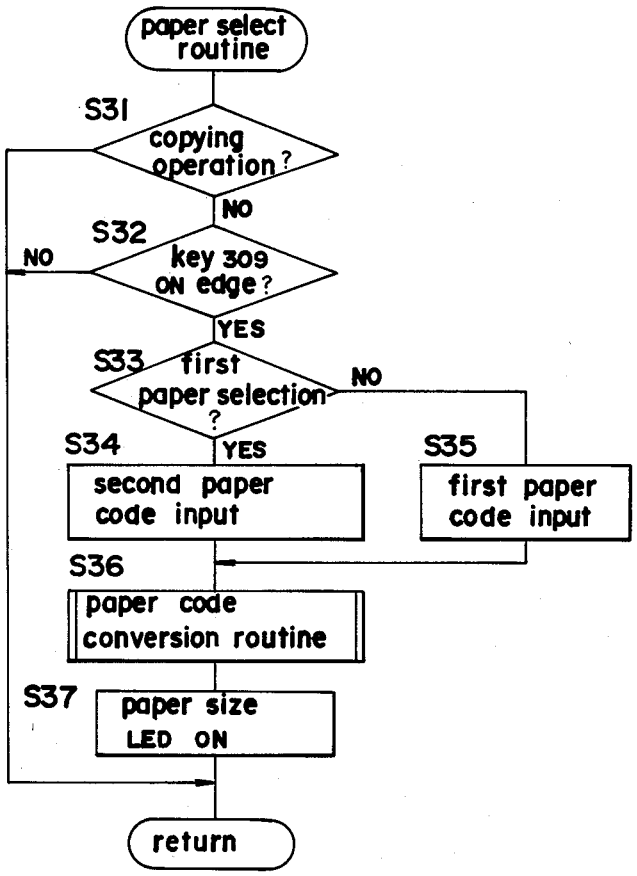

FIG. 24 is a copy paper select routine. First, it is judged whether copy operation is being continued or not in the step (S31). When the copy operation is being continued (YES), this routine terminates. If the copy operation is not being continued (NO), the ON edge of print key (309) is judged in the step (S32). When the off edge is confimred (YES), it is judged whether the first paper feed [storage (42)] is selected or not in the step (S33). When the first paper feed is selected (YES), the second paper feed [storage (43)] is selected. If the second paper feed is not selected (NO), the first paper feed is selected and the copy paper size code of the second paper feed and the copy paper size code of the first paper feed are input to the first CPU (340) in steps (S34) and (S35), respectively.

The copy paper size code conversion routine is called in step (S36) and the LED's (309*a*)–(309*d*) corresponding to the selected copy paper size being set in the storages (42), (43) light in step (S37).

A copy paper size code is previously set. Namely, the the code for lengthwise sending of paper in size B5 is "1", the code in size A4 is "2", the code in size B4 is "3" and the code in size A3 is "4".

Figure 25:
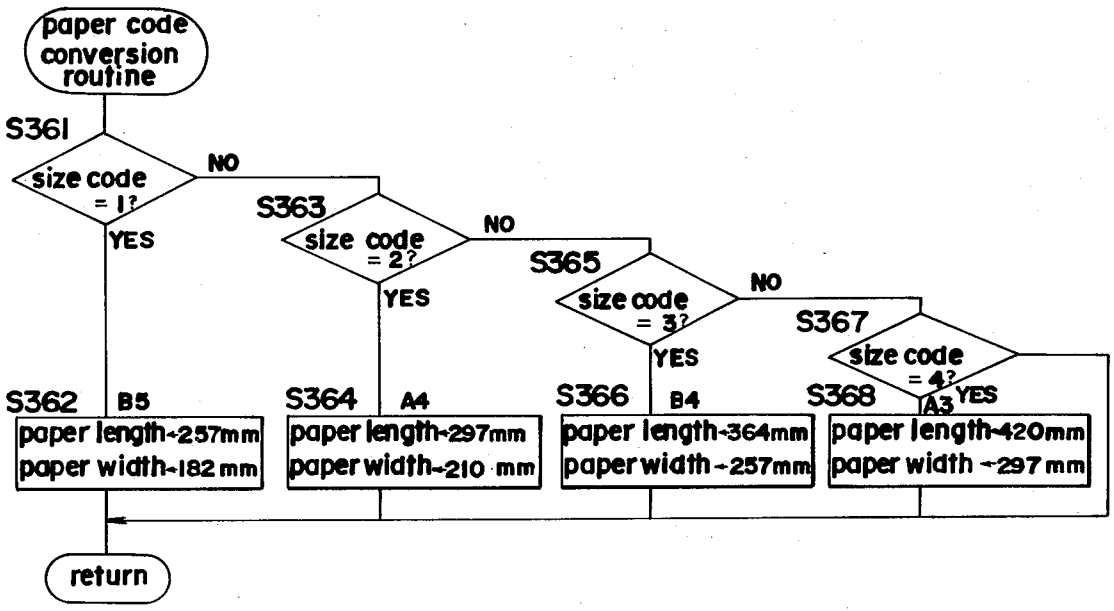

Therefore, in the copy paper size code conversion routine shown in FIG. 25, when it is confirmed that the size code input in step (S361) is "1", the length 257 mm and width 182 mm are stored in step (S362). In the same way, when the size code is "2" [YES in step (S363)], the length 297 mm and width 210 mm are stored in step (S364). When the size code is "3" [YES in step (S365)], the length 364 mm and width 257 mm are stored in step (S366). When the size code is "4" [YES in step (S367)], the length 420 mm and width 297 mm are stored in step (S368).

Figure 26:
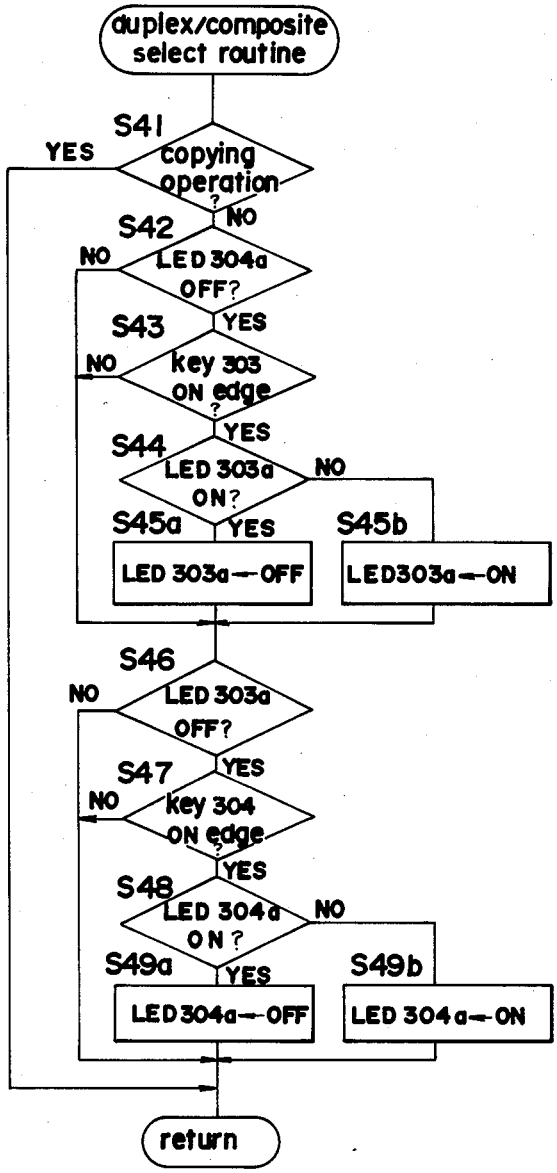

FIG. 26 is the duplex copying/composite copying select routine. First, it is judged whether the copying operation is continued or not in step (S41). When the copying operation is continued (YES), this routine terminates. If the copying operation is not continued (NO), it is judged in step (S42) whether LED (304*a*) is OFF or not, namely a composite copying is selected or not. When the composite copying is selected [LED(304*a*) off, NO], step (S46) immediately starts. If the composite copying is not selected [LED (304*a*) OFF, YES], the ON edge of duplex copying selection key (303) is judged in the step (S43). When the OFF edge is confirmed (YES), whether the LED (303*a*) is ON or not is judged in step (S44). When it is ON (YES), the LED (303*a*) is OFF in step (S45*a*). When it is ON (NO), the LED (303*a*) is ON in step (S45*b*).

Moreover, whether LED (303*a*) is OFF or not, namely whether the duplex copying is selected or not is judged in step (S46). If the duplex copying is not selected [LED (303*a*) OFF, YES], the ON edge of composite copying selection key (304) is judged in step (S47). When the ON edge is confirmed (YES), it is judged whether the LED (304*a*) is ON or not in step (S48). When LED, (304*a*) is ON (YES), the LED (304*a*) is OFF in step (S49*a*). When LED (304*a*) is ON (NO), LED (304*a*) is ON in step (S49*b*).

In this case, if there is the ON edge of any of the selection keys (303), (304), any one of LED (303*a*), (304*a*) turns ON or OFF [step (S45*a*), (S45*b*) and (S49*a*), (S49*b*)]. However, since the length of one routine is very short, the lighting condition is virtually maintained.

The copying operation in step S41 means the period between turning ON of the print key (301) and the end of final scanning of the selected copying mode. Therefore when duplex copying or composite copying is selected, changing to the other mode is inhibited until all copy papers in the intermediate tray 58 are re-fed.

Figure 27A:
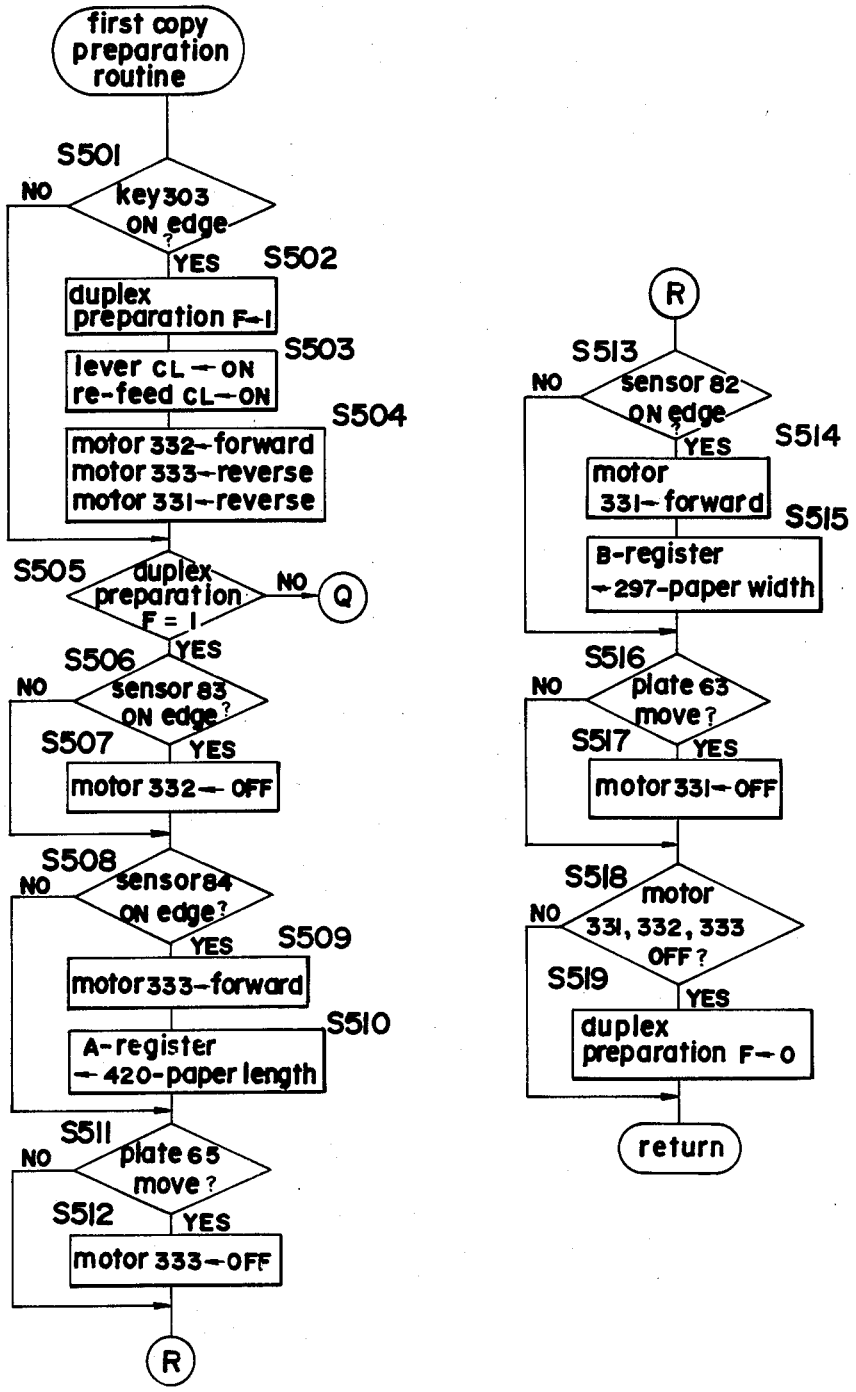
Figure 27B:
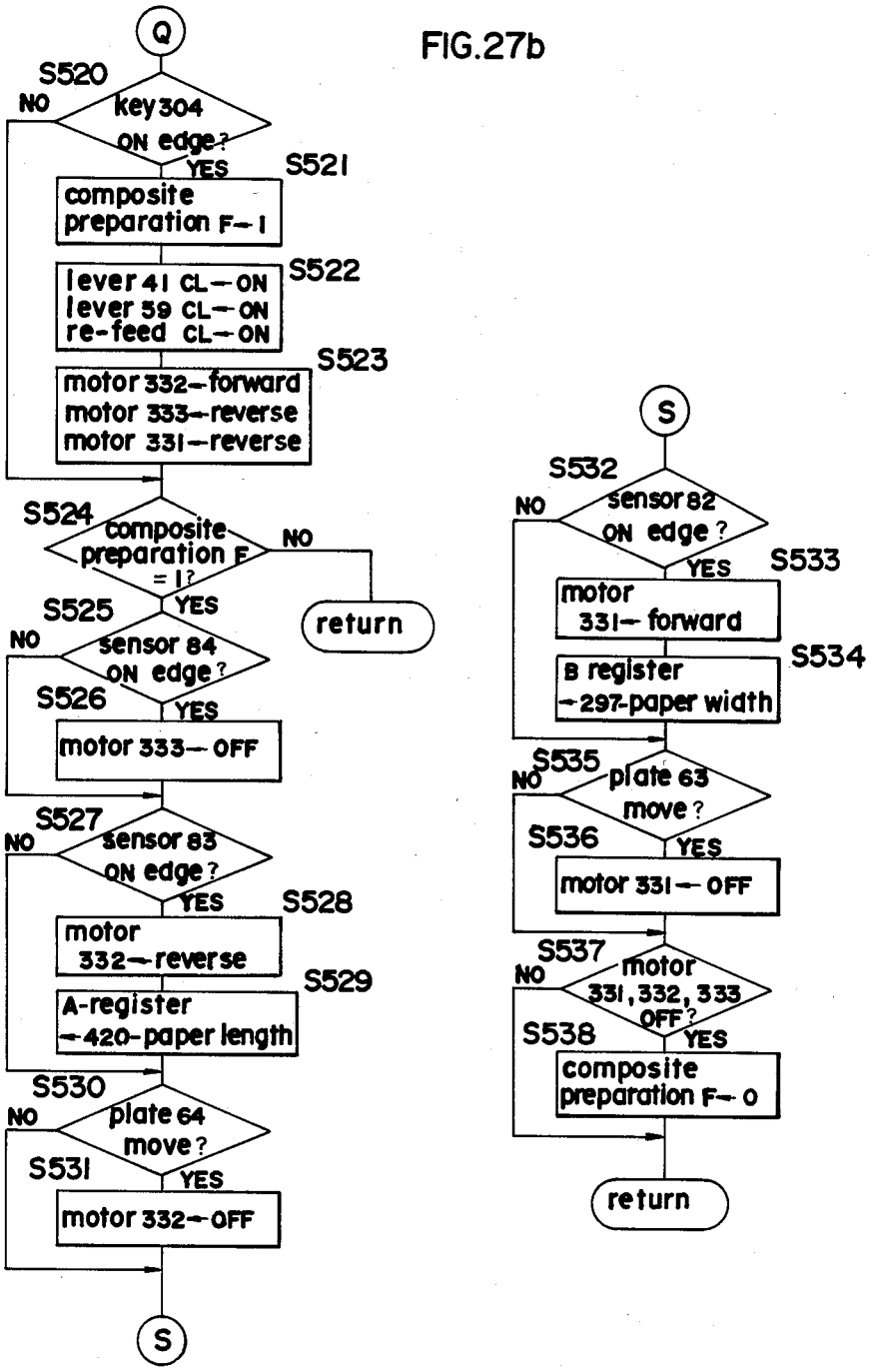

FIGS. 27(*a*) and 27(*b*) are a first copy preparation routine. The steps (S501)–(S519) are provided for the duplex copying preparation and the steps (S520)–(S538) for the composite copying preparation.

First, when the ON edge of the duplex copying selection key (303) is confirmed in step (S501), the duplex copying preparation flag is set to "1" in step (S502), the clutch of lever (41) and the clutch of the re-feeding roller (38) are turned ON in step (S503) to set the copy paper transporting route to the intermediate tray (58), and the re-feeding roller (38) is located in the upper stage. The solenoid of lever (59) is kept OFF and in this case the lever (59) changes the copy paper transporting route to the transfer block (11). Simultaenously, therewith the stepping motors (332), (333), (331) are turned ON in step (S504), moving the regulating plates (64), (65), (63). Namely, the front end regulating plate (64) moves in the re-feeding direction with forward rotation of the stepping motor (332) and moves in the reverse direction to the re-feeding direction with reverse rotation of the stepping motor (333), while the side regulating plate (63) moves outward.

Next, when it is confirmed that the duplex copying preparation flag is set to "1" in the step (S505) and the ON edge of sensor (83) is confirmed in step (S506), the forward rotation of stepping motor (332) is turned OFF in step (S507) and the front end regulating plate (64) is stopped at the solid line position shown in FIG. 8 and FIG. 9. When the ON edge of sensor (84) is confirmed in step (S508), the stepping motor (333) is changed to the forward rotation in step (S509) and the rear end regulating plate (65) is moved in the refeeding direction and a difference of copy paper length from 420 mm (stop position corresponding to the copy paper in the maximum length) is input to the A register and stored in step (S510). When it is confirmed that the rear end regulating plate (65) has moved in the re-feeding direction by the amount stored in the A register in step (S511), the stepping motor (333) is turned OFF in step (S512) and the rear end regulating plate (65) is stopped at the solid line position in FIG. 8 and FIG. 9.

When the ON edge of sensor (82) is confirmed in step (S513), rotation of stepping motor (331) is changed to the forward direction, the side regulating plate (63) is moved inward and a difference of copy paper width from 297 mm (stop position corresponding to the copy paper of the maximum width) is input to the B register in step (S515). When it is confirmed in step (S516) that the side regulating plate (63) has moved inside by the amount stored in the B register, the stepping motor (331) is turned OFF and the side regulating plate (63) is stopped at the solid line position shown in FIG. 8, FIG. 10 in step (S517).

Next, when it is confirmed that the stepping motors (331), (332), (333) are turned OFF in step (S518), the duplex copying preparation flag is reset to "0" in step (S519).

On the other hand, when NO is judged in step (S506) without selection of duplex copying, the ON edge of composite copying selection key (304) is confirmed in step (S520) and the composite copying preparation flag is set to "1" in step (S521*a*), the clutch of levers (41), (59) and the clutch of the re-feeding roller (38) are turned ON in step (S522), the copy paper transporting route is changed to the route where the copy paper is directly fed to the intermediate tray (58) and the re-feeding roller (38) is located at the upper stage. Simultaneously therewith, the stepping motors (332), (333), (331) are turned ON in step (S523) and the regulating plates (64), (65), (63) are moved as in the case of step (S504).

When it is confirmed that the composite copying preparation flag is set to "1" in step (S524) and the ON edge of sensor (84) is confirmed in step (S525), the forward rotation of stepping motor (333) is turned OFF in step (S526) and the rear end regulating plate (65) is stopped at the solid line position shown in FIG. 11 and FIG. 12. Moreover, when the ON edge of sensor (83) is confirmed in step (S527), rotation of stepping motor (332) is changed to the reverse rotation in step (S528) and the front end regulating plate (64) is moved in the reverse direction to the re-feeding direction and the difference of copy paper length from 420 mm [refer to step (S510)] to the register A is stored in step (S529). When it is confirmed in step (S530) that the front end regulating plate (64) has moved in the reverse direction by the amount stored in the A register to the re-feeding direction, the stepping motor (332) is turned OFF in step (S531) and the front end regulating plate (64) is stopped at the solid line position shown in FIG. 11 and FIG. 12.

Figure 13:
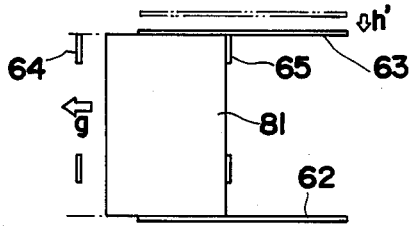
FIG. 13 is a top plan view of the alignment mechanism at the time of re-feeding of copy paper sheets.

Moreover, when the ON edge of sensor (82) is confirmed in step (S532), rotation of the stepping motor (331) is changed to the forward rotation in step (S532), and difference of copy paper width from 297 mm [refer to step (S515)] to the B register is stored in step (S534). When it is confirmed in step (S535) that the side regulating plate (63) has moved inside by the amount stored in the B register, the stepping motor (331) is turned OFF in step (S536) and the side regulating plate (63) is stopped at the solid line position shown in FIG. 13 and FIG. 15.

Next, when it is confirmed in step (S537) that the stepping motors (331), (332), (333) are turned OFF, the composite copying preparation flag is reset to "0" in step (S538).

Thus, preparation for accepting the paper, copied on one side, into the intermediate tray (58) is completed.

Figure 28:
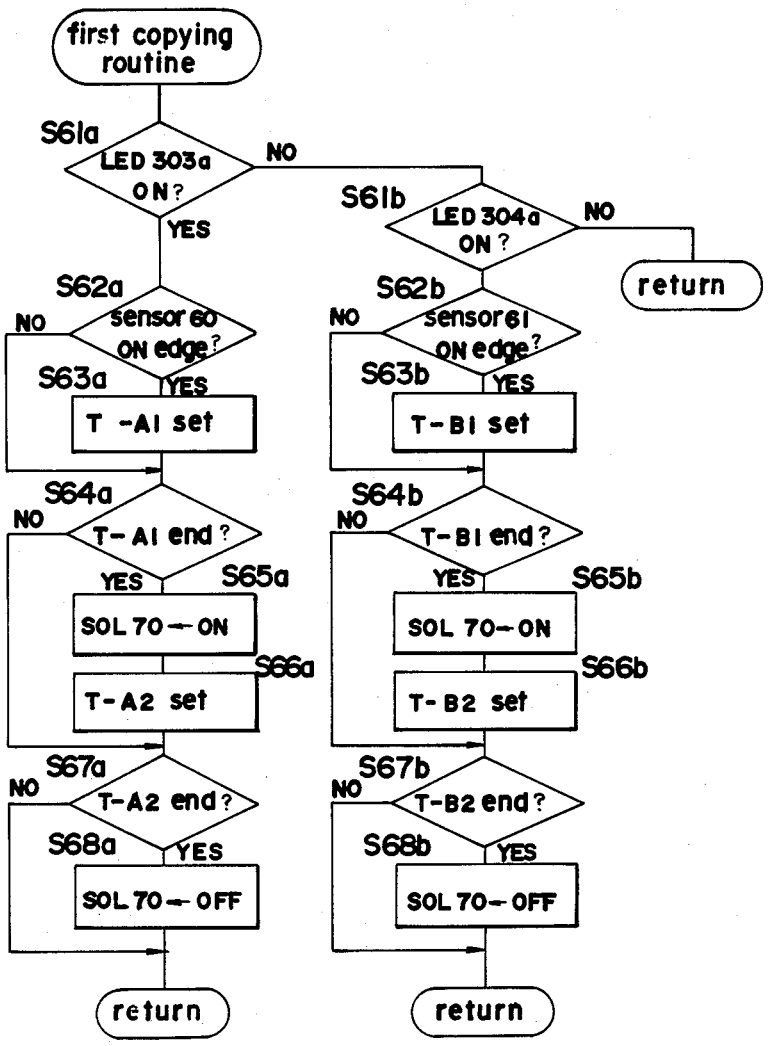

FIG. 28 is the first copying operation routine. This subroutine is a control procedure for preliminarily aligning the copy paper for each feeding of a copy paper sheet onto the intermediate tray (58) during the copying operation. First, it is judged at step (S61*a*) whether the duplex copyiing selection display LED (303*a*) is ON or OFF. When the duplex copying is selected (YES), the timer (A1) is set in step (S63*a*) after confirming the ON edge of sensor (60) in step (S62*a*). When the composite copying is selected, NO is judged in step (S61*a*), the composite copying selection display LED (304*a*) is judged ON (YES) in step (S61*b*). When ON edge of sensor (61) is confirmed in step (S62*b*), the timer (B1) is set in step (S63B). The timers (A1), (B1) are provided for causing a time lag until the front end of copy paper (81) reaches the intermediate tray (58) after turning ON the sensors (60), (61).

Next, when the termination timing of timers (A1), (B1) is confirmed in steps (S64*a*), (S64*b*) even in the case of the duplex copying or composite copying mode, the solenoid (70) is turned ON in steps (S65*a*), (S65*b*) and the size regulating plate (62) is swayed outside (refer to FIG. 16) and the timers (A2), (B2) are set in steps (S66*a*), (S66*b*). These timers (A2), (B2) are used for the timing until the copy paper (81) is perfectly fed to the intermediate tray (58). When the end timing of these timers (A2), (B2) are confirmed in steps (S67*a*), (S67*b*), the solenoid (70) is turned OFF in steps (S68*a*), (S68*b*) and the copy papers (81) are placed inside of the side regulating plate (62) (refer to FIG. 17). Setting of the timers (A2), (B2) in steps (S66*a*), (S66*b*) may be done with the signal which has been used by the sensors (60), (61) to detect the rear end edge of copy paper for correspondence to the copy paper size.

Figure 29:
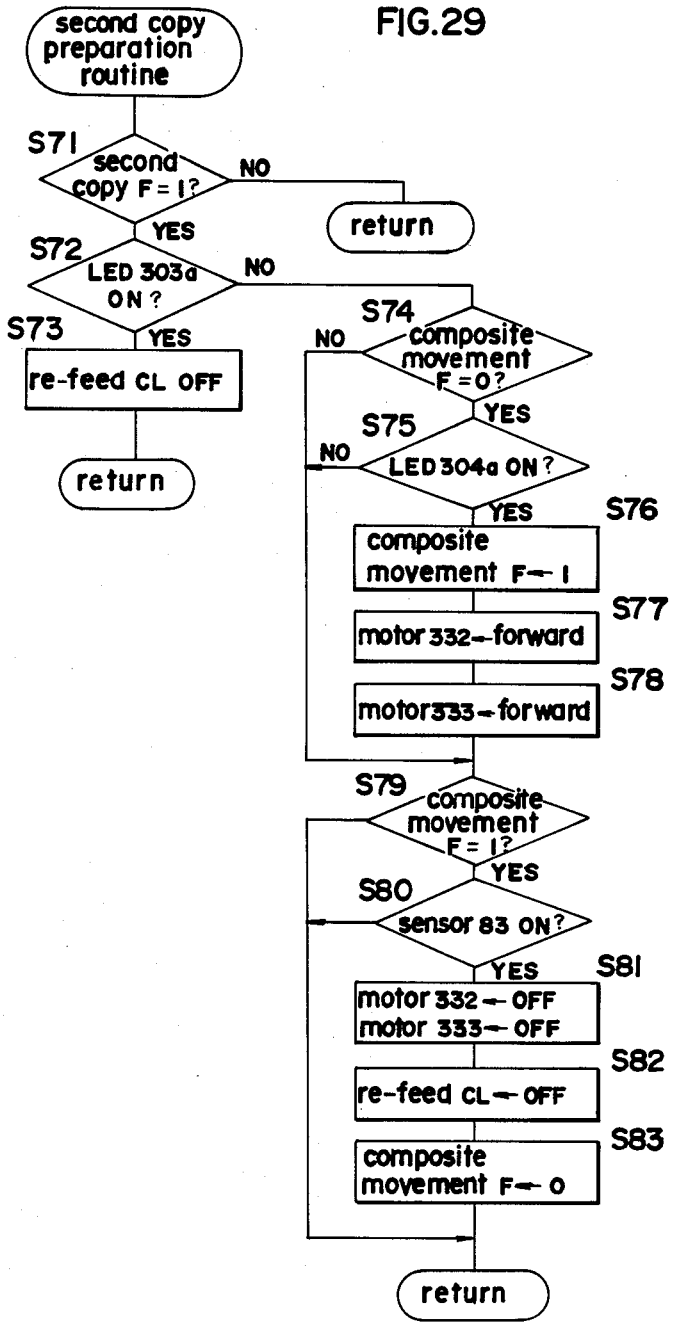

FIG. 29 shows the second copying operation routine. This subroutine is a control procedure for preparing for re-feeding. First, whether the second copy flag is "1" or not is judged in step (S71). The second copy flag is set to "1" when copying on a single side [refer to the steps (S134)]. When it is set to "1" (YES) in step (S71), whether the duplex copying selection display LED (303*a*) is ON or not is judged in step (S72). When the duplex copying is selected (YES), the re-feeding clutch is turned ON immediately in step (S73) and the re-feeding roller (38) is pressurizingly placed in contact with the aligned copy paper (81) on the intermediate tray (58).

Meanwhile, when the composite copying is selected, NO is judged in said step (S72) and whether composite movement flag is "0" or not is judged in step (S74). When the composite movement flag is "0", it causes the copy paper (81) to move to the re-feeding position during the composite copying operation. When NO is judged in step (S74), whether the composite copying selection display LED (304*a*) is ON or not is judged. When the LED is ON (YES), the composite movement flag is set to "1" in step (S76) and the stepping motors (332), (333) are rotated normally in steps (S77), (S78) and the regulating plates (64), (65) are moved in the re-feeding direction.

Upon confirming that the composite movement flag is set to "1" in step (S79), whether the sensor (83) is ON or not is judged in step (S80), namely it is confirmed that the copy paper (81) is moved to the re-feeding position. Thereafter, the stepping motors (332), (333) are turned OFF in step (S81). The re-feeding clutch is turned OFF in step (S82), the re-feeding roller (38) is placed under pressure in contact with the copy paper (81) which has beem moved to the re-feeding position, and the composite movement flag is reset to "0" in step (S83), completing this subroutine.

Figure 30A:
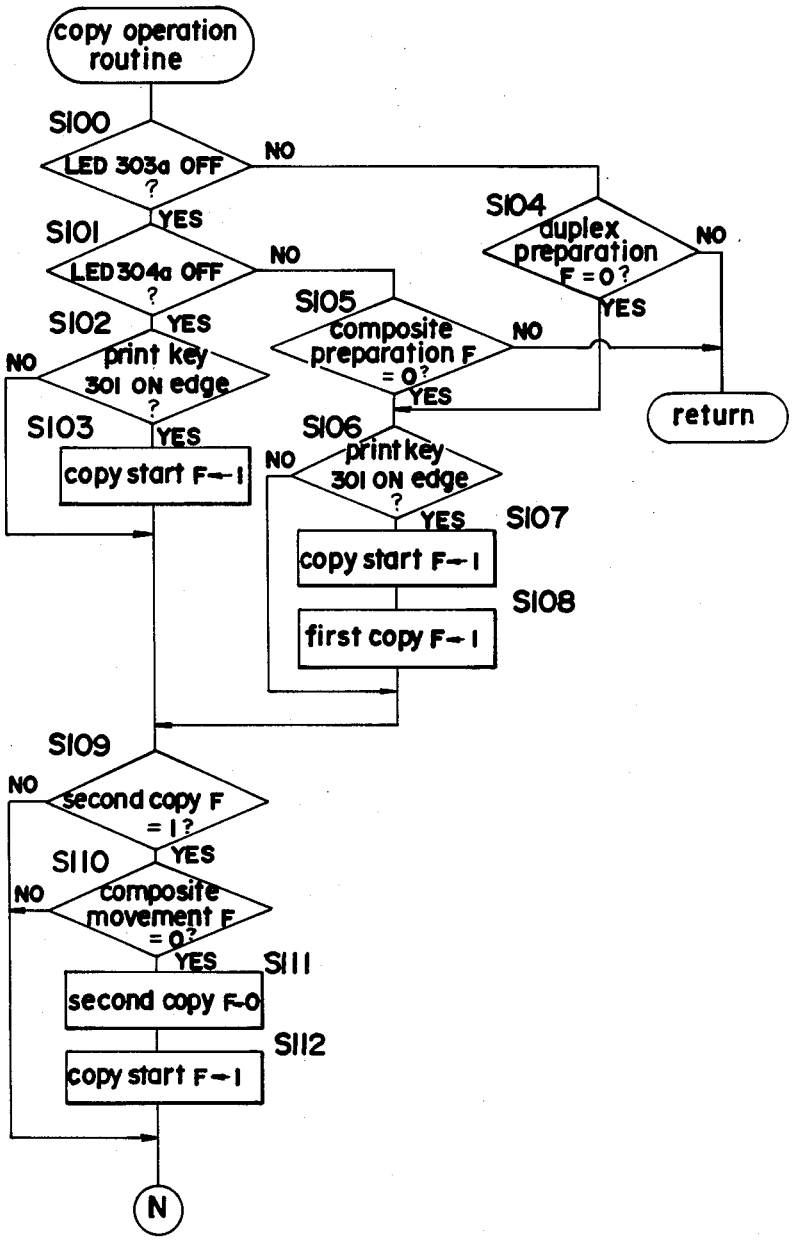
Figure 30B:
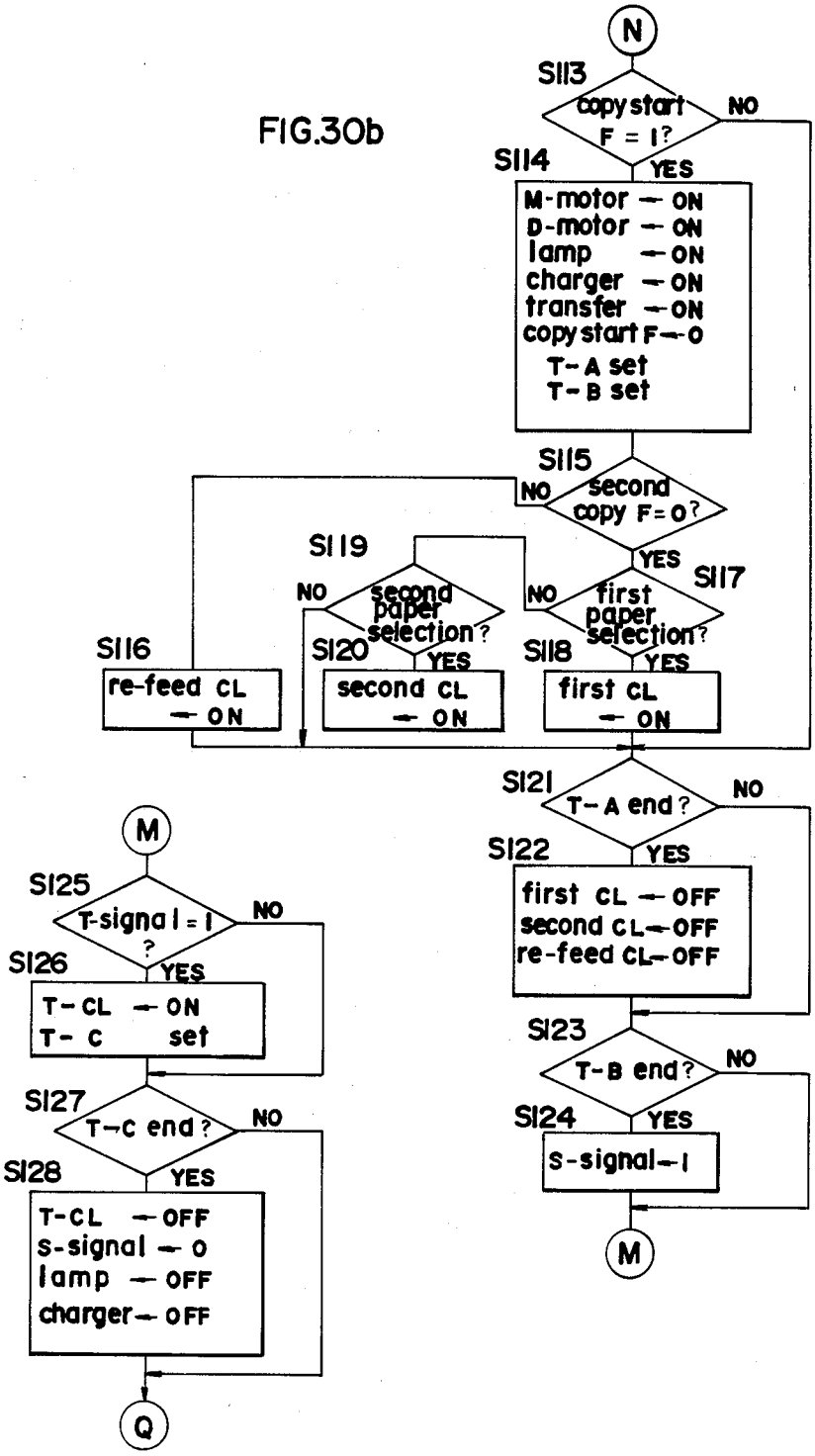
Figure 30C:
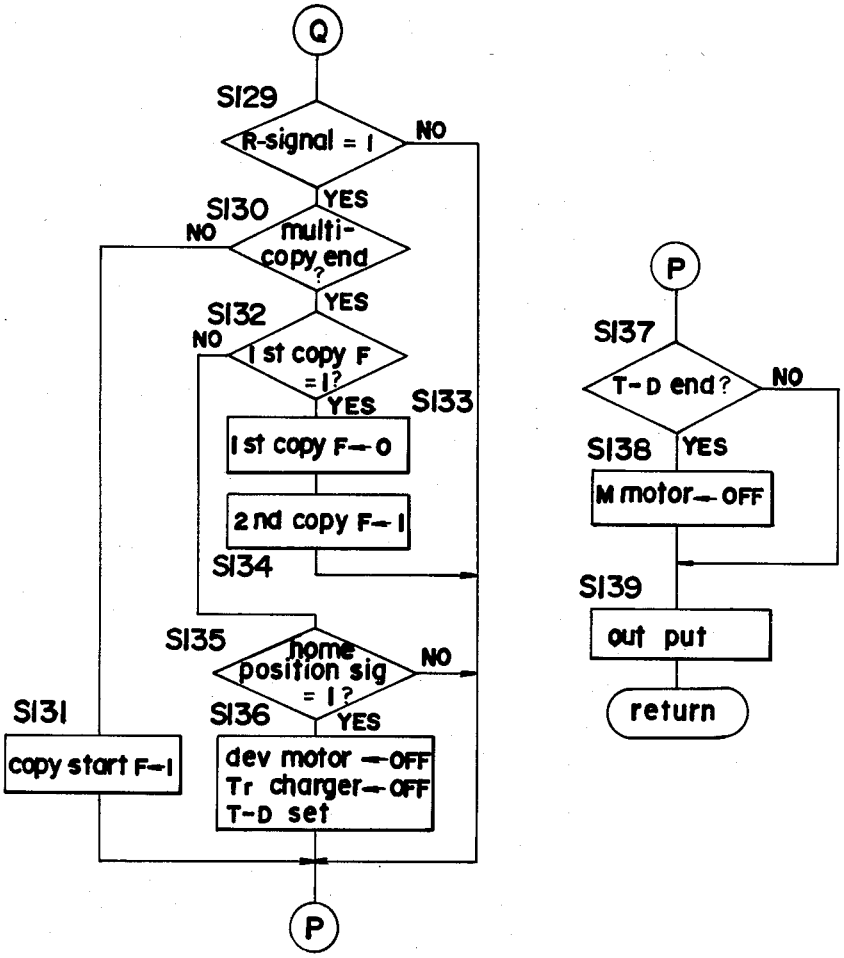

FIGS. 30*a*, 30*b* and 30*b* are copying operation routines. First, whether LED's (303*a*),(304*a*) are OFF or not is judged in steps (S100), (S101). When both are OFF (YES), namely when any of duplex copying and composite copying is not selected, if the ON edge of print key (301) is confirmed in step (S102) (YES), the copy start flag is set to "1" in step (S103) and operation moves to step (S109).

Meanwhile, when the duplex copying is selected, NO is judged in step (S100) and whether the duplex reference flags are 0 or not is judged in step (S104). When it is reset to 0, namely it is reset to 0 in step (S519) through said first copy preparation routine, judgment is YES. When the ON edge of print key (301) is confirmed in step (S106) (YES), the copy start flag is set to "1" in step (S107), the first copy flag is set to "1" in step (S108) and the step moves to step (S109).

When the composite copying is selected, judgment in step (S100) is YES and judgment in step (S101) is NO. In step (S105), whether the composite copying preparation flag is "0" or not is judged. When it is reset to "0" namely it is reset to "0" in step (S538) through said first copying preparation routine, judgement is YES. In succession, when the ON edge of print key (301) is confirmed in step (S106) (YES), the copy start flag and first copy flag are set to "1" in (S107), (S108) and step (S109) starts.

In step (S109), it is judged whether the second copy flag is "1" or not. When it is "1" (YES), the composite movement flag is reset to "0" in step (S110) (YES) and thereafter the second copy flag is reset to "0" in step (S111), setting the copy start flag to "1" in step (S112).

Successively, whether the copy start flag is "1" or not is judged in step (S113). When it is "1" (YES), the main motor is driven in the step (S114) to rotatingly drive a photosensitive drum (2) setting the copy paper transport roller, etc. ready for operation. Moreover, an exposure lamp (10), a corona charge (6), a transfer charge (5*a*) are turned ON and the developing motor is also turned ON. Simultaneously therewith, said copy start flag is reset to "0". Moreover, the timer (A) for controlling the paper feed system and the timer (B) for controlling the optical system (1) are set.

Next, whether the second copy flag is "0" or not is judged in step (S115). When the duplex copying or composite copying is selected and re-feeding is possible, since the second copy flag is being set to "1", judgment is NO in step (S115). The re-feeding roller clutch is turned ON in step (S116), a sheet of copy paper is re-fed from the intermediate tray (58) and step (S121) starts.

On the other hand, in the ordinary simplex copying onto a single side, judgement is YES in step (S115) and whether the first paper feeder is selected or not is judged in step (S117) and whether the second paper feeder is selected or not is judged in step (S119). The paper feed clutch selected in step (S118) or (S120) is turned ON, a sheet of copy paper is fed and step (S121) starts.

In succession, when the end timing of said timer (A) is confirmed in step (S121), the first, second paper feed roller clutches or re-feed clutch is turned OFF in step (S122). Moreover, when the end timing of said timer (B) is confirmed in step (S123), the scan signal is turned ON in step (S124) and the optical system (1) is caused to scan in the direction of arrow mark (b) of FIG. 1.

Whether the timing signal is turned ON or not is judged, namely whether the timing switch provided on the scanning locus of optical system (1) is turned ON and the timing for feeding copy paper from the timing rollers (13) has come or not is judged in step (S125). When judgment is YES, the timing roller clutch is turned ON in step (S126) and the copy paper is fed to the transfer part and the timer (C) is set. When the end timing of said timer (C) is confirmed in step (S127), the timing roller clutch is turned OFF in step (S128) and the scan signal is also turned OFF, causing the exposure lamp (10) and corona charger (6) to become OFF.

When the return signal is turned ON in step (S129) namely when the optical system (1) starts to return to the home position from the scanning end position, whether copying of the predetermined number of sheets been completed or not is judged in step (S130). When judgment is NO in this step (S130), the copy start flag is set again to "1" in step (S131). When judgment is YES in this step, whether the first copy flag is "1" or not is judged in step (S132). The first copy flag is set to "1" when the duplex copying or composite copying is executed [refer to step (S108)]. When judgment is YES, the first copy flag is reset to "0" in step (S133) in order to reset the duplex copying or composite copying operation and the second copy flag is set to "1" in step (S134).

When the continuous copying been completed [YES in step (S130)] and the first copy flag is set to "1", it is confirmed with the turning ON of the fixed position switch in step (S135) in order to complete the copying operation that the optical system (1) has returned to the movement -start position. Thereafter, the developing motor and corona charger (5*a*) are turned OFF and the timer (D) is set in step (S136). When the end timing of said timer (D) is confirmed in step (S137), the main motor is turned OFF in step (S138) and rotation of the photosensitive drum (2) is stopped. Next, results of the processings carried out heretofore are output in process (S139) and the step returns to the main routine.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying apparatus comprising:

a first sheet feed means for storing sheets to be copied and feeding them one by one therefrom;

an image forming means for forming a copied image on the sheets fed by the first sheet feed means;

a second sheet feed means for receiving the copied sheets and re-feeding them one by one thereform to the image forming means, said second sheet feed means having first and second inlets provided at different places from each other for receiving the copied sheets, a tray member for supporting the received sheets and an outlet through which the received sheets are refed, wherein the received status of the sheets on said tray member received through said first inlet is reversed in front and rear side from the sheets received through said second inlet;

means for aligning the sheets received through said first inlet at a first position and for aligning the sheets received through said second inlet at a second position;

a first transport means for transporting the copied sheets from the image forming means to said first inlet of the second sheet feed means;

a second transporting means for transporting the copied sheets from the image forming means to said second inlet of the second sheet feed means;

a change-over means for selectively sending the sheets to the first or second transport means;

a first mode designating means for designating a duplex mode where images are formed on both sides of a sheet;

a second mode designating means for designating a composite mode wherein images are formed plural times on the same surface of a sheet; and a control means for controlling the change-over means and the sheet aligning means in accordance with mode selection by the mode designating means.

2. A copying apparatus comprising:

a first sheet feed means for storing sheets to be copied and feeding them one by one therefrom;

an image forming means for forming a copied image on the sheets fed by the first sheet feed means;

a second sheet feed means for receiving the copied sheets and re-feeding them one by one therefrom to the image forming means, said second sheet feed means having first and second inlets provided at different placed from each other for receiving the copied sheets, a tray member for supporting the received sheets and an outlet through which the received sheets are refed, wherein the received status of the sheets on said tray member received through said first inlet is reversed in front and rear sides from the sheets received through said second inlet;

means for aligning the sheets received through said first inlet at a first position and for aligning the sheets received through said second inlet at a second position;

a first transport means for transporting the copied sheets from the image forming means to said first inlet of the second sheet feed means;

a second transporting means for transporting the copied sheets from the image forming means to said second inlet of the second sheet feed means;

a change-over means for selectively sending the sheets to the first or second transport means;

a first mode designating means for designating a duplex mode where images are formed on both sides of a sheet;

a second mode designating means for designating a composite mode where images are formed plural times on the same surface of a sheet; and a control means for controlling the change-over means and the sheet aligning means in accordance with mode selection by the mode designating means, wherein the copied paper is sent to the first transport means and aligned at the first position in the second feet means when the duplex mode is designated, and the copied paper is sent to the second transport means and aligned at the second position in the second feed means when the composite mode is designated.

3. A copying apparatus comprising:

a first sheet feed means for storing sheets to be copied and feeding them one by one therefrom;

means for detecting the size of sheets stored in the first sheet feed means;

an image forming means for forming a copied image on the sheets fed by the first sheet feed means;

a second sheet feed means for receiving the copied sheets and re-feeding them one by one therefrom to the image forming means, said second sheet means having first and second inlets provided at different places from each other for receiving the copied sheets, a tray member for supporting the received sheets and an outlet through which the received sheets are refed, wherein the received status of the sheets on said tray member received through said first inlet is reversed in front and rear sides from the sheets received through said second inlet;

means, having movable aligning members, for aligning the sheets received through said first inlet at a first position and for aligning the sheets received through said second inlet at a second position;

a first transport means for transporting the copied sheets from the image forming means to said first inlet of the second sheet feed means;

a second transporting means for transporting the copied sheets from the image forming means to said second inlet of the second sheet feed means;

a change-over means for selectively sending the sheets to the first or second transport means;

a first mode designating means for designating a duplex mode where images are formed on both sides of a sheet;

a second mode designating means for designating a composite mode where images are formed plural times on the same surface of a sheet;

a first control means for controlling the change-over means in accordance with mode selection by the mode designating means; and, a second control means for controlling the aligning means so as to move the aligning members to a suitable position in accordance with mode selection by the mode designating means and the sheet size detected by the detecting means.

4. A copying apparatus comprising:

a first sheet feed means for storing sheets to be copied and feeding them one by one therefrom;

an image forming means for forming a copied image on the sheets fed by the first sheet feed means;

a second sheet feed means for receiving the copied sheets and re-feeding them one by one therefrom to the image forming means, said second sheet feed means having first and second inlets provided at different places from each other for receiving the copied sheets, a tray member for supporting the received sheets and an outlet through which the received sheets are refed, wherein the received status of the sheets on said tray member received through said first inlet is reversed in front and rear sides from the sheets received through said second inlet;

means for aligning the sheets received through said first inlet at a first position and for aligning the sheets received through said second inlet at a second position;

a first transport means for transporting the copied sheets from the image forming means to said first inlet of the second sheet feed means;

a second transporting means for transporting the copied sheets from the image forming means to said second inlet of the second sheet feed means;

a change-over means for selectively sending the sheets to the first or second transport means;

a first mode designating means for designating a duplex mode wherein images are formed on both sides of a sheet;

a second mode designating means for designating a composite mode wherein images are formed plural times on the same surface of a sheet;

a first detecting means for detecting the sheets transported by the first transport means;

a second detecting means for detecing the sheets transported by the second transport means;

a first control means for controlling the change-over means in accordance with mode selection by the mode designating means; and a second control means for controlling the aligning means in accordance with the detection by the first detecting means or the second detecting means, one of said detecting means being used selectively in accordance with the selected mode.

5. A copying apparatus comprising:

a first sheet feed means for storing sheets to be copied and feeding them one by one therefrom;

an image forming means for forming a copied image on the sheet fed by the first sheet feed means;

a second sheet feed means for receiving the copied sheets and re-feeding them one by one therefrom to the image forming means, said second sheet feed means includes a sheet aligning mechanism for aligning the received sheet;

a first transport means for transporting the copied sheets from the image forming means to the second sheet feed means;

a second transporting means for transporting the copied sheets from the image forming means to the second sheet feed means, wherein the status of the received sheets transported by the second transporting means in the second feed means are reversed in front and rear sides from the sheet transported by the first transport means;

a change-over means for selectively sending the sheets to the first or second transport means;

a first mode designating means for designating a duplex mode wherein images are formed on both sides of a sheet;

a second mode designating means for designating a composite mode wherein images are formed plural times on the same surface of a sheet; and an inhibiting means for inhibiting the change of a selected mode until the completion of copy operation in the selected mode.

6. A copying apparatus as claimed in claim 2, further comprising: means, provided in said second feed means, for transporting the aligned sheets at the second position to the first position.

7. A copying apparatus as claimed in claim 6, wherein said aligning means aligns the transported sheets at the first position.

8. A copying apparatus as claimed in claim 4, wherein said aligning means includes a plurality of aligning members which are movable between the first position and second position.

9. A copying apparatus as claimed in claim 8, wherein said aligning members are moved to the first position or to the second position in response to the selected mode.

* * * * *